United States Patent [19]

Junemann

[11] Patent Number: 4,736,695

[45] Date of Patent: Apr. 12, 1988

[54] AUTOMATIC SEWING DEVICE FOR SEWING TOGETHER A TUBULAR WORKPIECE AND A POCKET-SHAPED WORKPIECE

[75] Inventor: Hubert Junemann, Biefield, Fed. Rep. of Germany

[73] Assignee: Kochs Adler, AG, Fed. Rep. of Germany

[21] Appl. No.: 53,347

[22] Filed: May 22, 1987

Related U.S. Application Data

[63] Continuation-in-part of Ser. No. 865,254, May 20, 1986, Pat. No. 4,685,407.

[30] Foreign Application Priority Data

May 23, 1985 [DE] Fed. Rep. of Germany ..... 3518473

[51] Int. Cl.[4] ..... D05B 21/00; D05B 35/00

[52] U.S. Cl. ..... 112/121.12; 112/147; 112/121.14; 112/153

[58] Field of Search ..... 112/121.12, 121.11, 112/121.14, 121.15, 63, 10, 102, 104, 147, 153

[56] References Cited

U.S. PATENT DOCUMENTS

| | | | |
|---|---|---|---|
| 2,313,433 | 3/1943 | Golden | 112/104 |
| 2,702,014 | 2/1955 | Bownstein | 112/121.15 |
| 2,900,934 | 8/1959 | Judelson | 112/63 |
| 3,329,110 | 7/1967 | Bergeron | 112/121.11 |
| 3,513,791 | 5/1970 | Fulp | 112/121.15 X |
| 3,611,959 | 10/1971 | Laurelton et al. | 112/104 |
| 3,613,610 | 10/1971 | Hinenfeld et al. | 112/262.3 |
| 3,779,185 | 12/1973 | Sakakura et al. | 112/121.12 |
| 4,370,936 | 2/1983 | Moyer et al. | 112/63 X |

*Primary Examiner*—H. Hampton Hunter

*Attorney, Agent, or Firm*—Laff, Whitesel, Conte & Saret

[57] ABSTRACT

In an automatic sewing device for sewing together tubular workpieces such as sleeves, and pocket-shaped workpieces, such as cuffs, there are provided an inner clamp, a central clamp and an outer clamp. These clamps are associated with an inner sleeve clamp and an outer sleeve clamp, the latter being associated with a folding device for gathering up a material fullness of the tubular workpiece. Devices are also provided for opening the pocket-shaped workpiece in order that the border of the tubular workpiece may be inserted and positioned. The associated sewing machine can be moved in a straight line relative to the parts described. A part of the border of the tubular workpiece is positioned in the pocket-shaped workpiece and sewn to the latter by means of a straight-line seam. Subsequently, the clamping in this area is released and the positioning of the border of the tubular workpiece in the pocket-shaped workpiece is carried out and clamping is effected. Following this, the second partial seam is also sewn in a straight line and flat, hereby producing between the workpieces a seam which corresponds to the then approximately circular path of the joining seam between the workpieces.

15 Claims, 13 Drawing Sheets

1
182
63
189
180
181
190
274
145
147
152
148
60
2
151
98
62
275
277
105
186
187
183
185
184
188
XVII
240
192
261
241
242
262
191
278
110
118
141
263
243
193
244
246
259
252
253
X
247
258
245
250
256
78
77
102
140
74
246
248
249
254
75
97
IV
272
80
265
267
189
68
69
81
187
270
271
79
268
269
273
76
264
266
73
71
72
70
10
6
260
13
11
4
67
III
65
42
42a
23
66

1
36
39
40
24
29
30
31
32
29
25
250
188
37
38
266
256
26
264
271a
10
182
190
273
42
44
63
42a
62
73
27
260
144
43
28
60
41
180
21
142
VI
9
7
76
4
19
148
6
5
3
325
2
14
20
13
12
15
11
5
8
4
147
154
152
146

244
250
247
245
248
62
63
258
260
259
27

256
249
246
245
244
250
251
252
253
63
248
249
254
255
62

164
169
162
170
162
IX
168
163
166
167
157
165
160

169
163
78
170
98
62
162
164
168
161
159
160

Fig. 32
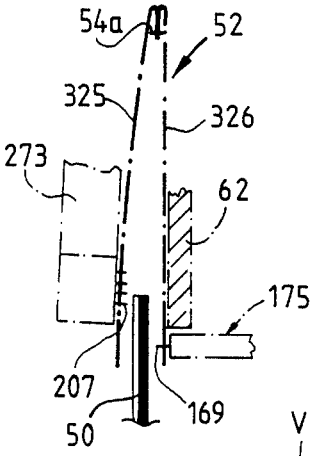
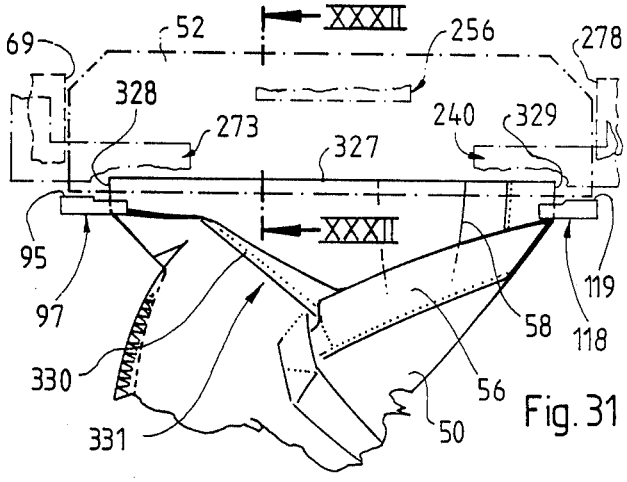
Fig. 31
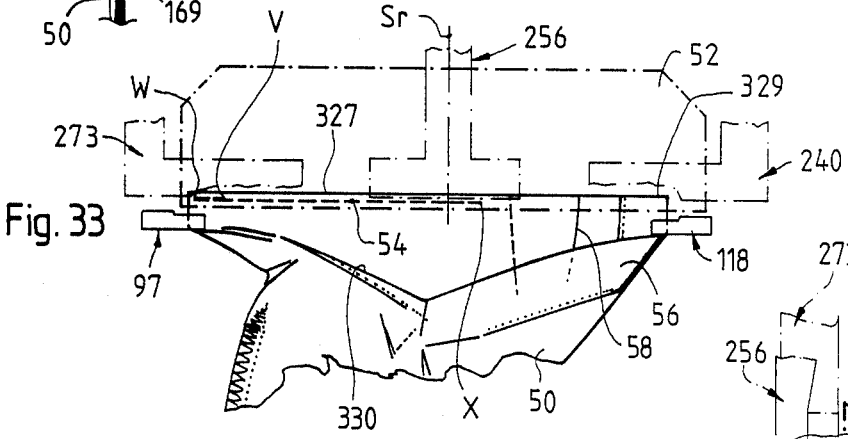
Fig. 33
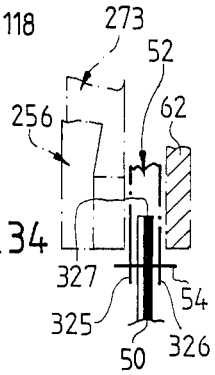
Fig. 34
Fig. 35
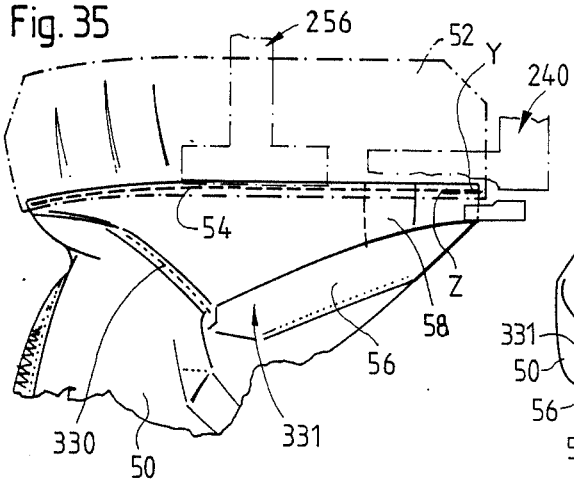
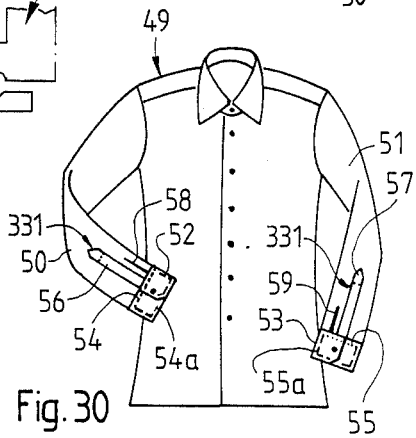
Fig. 30

AUTOMATIC SEWING DEVICE FOR SEWING TOGETHER A TUBULAR WORKPIECE AND A POCKET-SHAPED WORKPIECE

This is a continuation-in-part of my application Ser. No. 06/865,254, filed May 20, 1986 now U.S. Pat. No. 4,685,407 dated Aug. 11, 1987.

FIELD OF THE INVENTION

The invention relates to an automatic sewing device for sewing together a border of a tubular workpiece, which has a slit dividing the border, and a pocket-shaped workpiece which consists of two partially connected layers, the pocket-shaped workpiece being positioned, clamped and opened, the border being drawn up during widening of the slit and inserted into the open pocket-shaped workpiece and positioned, the tubular workpiece being clamped on lateral edges of the slit in the area of the border and the tubular workpiece and the pocket-shaped workpiece being sewn together. Furthermore, the invention is related to an automatic sewing device for carrying out this method, comprising a sewing machine and at least one workpiece holder which has at least one support for supporting the workpieces, stops for positioning the workpieces, devices for opening the pocket-shaped workpiece, clamps for the pocket-shaped workpiece, clamps for retaining the tubular workpiece on the lateral edges in the border area and at least one folding device for gathering the material fullness, the sewing machine and the workpiece holder being movable relative to one another.

BACKGROUND OF THE INVENTION

Tubular workpieces of the afore-mentioned kind and correspondingly associated pocket-shaped workpieces can—as a combination in each case—be a sleeve and the associated cuff, a trouser leg of a pair of trousers having a waistband and the associated waistband, a sports shirt and the associated collar, and the like. In all cases there is the problem that the tubular part has a slit which divides the border to be sewn, but that the border can no longer be extended or stretched in a straight line so that the sewing together of two such parts raises problems. Cuffs, collars, waistbands or the like, which are the pocket-shaped workpieces, are already closed on all sides by sewing and only remain open in the area into which the border of the tubular workpiece is to be inserted, whereupon the sewing together of these two parts then takes place.

The sewing together of two such workpieces, that is particularly the sewing of cuffs to sleeves by means of a sewing machine and manual guidance of the workpieces in the sewing machine, is effected in such a manner that the sewer opens the pocket-shaped workpiece, i.e. the cuff, and inserts the border of the tubular workpiece, i.e. the sleeve, the lateral edge which defines the slit in the border area being positioned in the cuff against the outer edge thereof. Then the sewer sews a partial seam. She subsequently positions the other lateral edge on the other end of the open cuff and draws the required sleeve material fullness into a fold. Subsequently the seam is completed by producing a second partial seam. The sewing of waistbands to trouser legs and of collars to sports shirts is effected in a manner which is identical in principle, there being no material fullness in the actual shirt part in the case of sports shirts. This sewing of cuffs to shirt sleeves is described in the journal of the Bekleidungstechnische Schriftenreihe, Vol. 6, pages 172, 173 and 222, "Arbeitsgestaltung in der Hemdenfertigung" by Karl Friedrich Koller and Ingrid Koch (in English: Clothing Industry Publications, Vol. 6, pages 172, 173 and 222, "Methods in shirt manufacture"). The disadvantage in this case is that the sewer needs a very long period of training. The sewing of right and left sleeves alternately requires constant rethinking. Because the joining seam between the sleeve and cuff is a visible seam, it must be designed to be particularly neat and straight. In order that the sleeves do not have different lengths, a border of equal width must be inserted into each cuff.

A method and an automatic sewing device of the type as afore-mentioned are disclosed in U.S. Pat. No. 3,779,185. Here the cuff and sleeve are mounted on cylindrical drums, i.e. sewing is effected in the form which the cuff will subsequently take on the sleeve. For this purpose the presewn cuff is retained in the area of its closed edges on a partly cylindrical supporting surface by means of clamps. Because the cuff projects over this supporting surface, it opens slightly. The cuff is opened by means of fingers which move in between the cuff layers and can swing outwardly, so that subsequently the sleeve border which is premounted on a partly cylindrical slider can be inserted in the open cuff. The lateral edge area of the sleeve is fixed on this slider by means of clamps. The material fullness which is normally present on sleeves is gathered in a pleat by means of a folding devices. After the two layers of the cuff and the edge lie firmly one upon the other, they are sewn in one operation over a circle arc segment by appropriate pivoting of the workpiece holder relative to the sewing machine. Because of the drum-shaped design of the workpiece holder the known automatic sewing device is extremely costly and the method to be used on this device is very complicated.

SUMMARY OF THE INVENTION

It is one essential object of the invention to provide a method of sewing together a border of a tubular workpiece, which has a slit dividing the border and a pocket-shaped workpiece which can also be carried out simply by fully automatic mechanical means. It is a further essential object of the invention to provide an automatic sewing device with simple design for carrying out the method.

The essence of the invention is that the pocket-shaped part is arranged in a plane, i.e. not on a drum, and that the border of the tubular part is likewise arranged in a plane and the border of the tubular part is likewise arranged in a plane and clamped in the area of its lateral edges when already inserted into the pocket-shaped part. In this case sufficient material fullness is gathered up so that the lateral edges are still arranged at a distance from the corresponding outer edges of the pocket-shaped workpiece. If, after positioning of the first lateral edge, the first partial seam is sewn in a straight line and the already sewn areas of the tubular and pocket-shaped parts are released from their clamps, the already sewn together section can arch upwardly when the other lateral edge of the workpiece is positioned in the area of the corresponding outer edge of the pocket-shaped workpiece. By dividing the positioning and sewing operations into distinctly separate stages the sewing operations can be performed in an absolutely straight line, the largely bent shape of a sleeve with a cuff, a sports shirt with a collar or a trouser leg with a waistband still being achieved in the end.

With the aid of a central clamp which is arranged between the inner and outer clamps and which is also set back relative to the section to be sewn, the tubular workpiece can also be additionally retained after sewing of the first part seam so that the effects according to the invention are achieved in a particularly favourable manner because the inner and outer clamps do not have to extend over half the width of the seam to be sewn.

If there are provided upper and lower holders which grip the pocket-shaped workpiece on the outer faces of its two layers and which are vertically drivable, the opening of the pocket-shaped workpiece does not have to take place in the area into which the border of the tubular workpiece is inserted for sewing so that the opening which is formed when the two layers of the pocket-shaped workpiece are drawn apart is completely free from any parts of the automatic sewing device.

The flat design of the workpiece holder permits adjustment, in a particularly simple manner, to different sizes of workpieces which are to be sewn together. Furthermore, the flat design permits in a particularly simple manner a symmetrical arrangement of two workpiece holders so that, for example, alternately in each case left and right sleeves and left and right cuffs or left and right trouser legs and corresponding waistbands can be sewn together. In this connection the sewing machine may be moved only in a straight line relative to each of the workpiece holders. If, for reasons of stability, each of the slots provided in the workpiece holders for sewing is closed particularly at the end adjacent to the sewing machine, then a slot is provided in the workpiece holder for the needle of the sewing machine to pass through, the holder being closed on its side adjacent to the sewing machine when the latter is in its inoperative position, and the sewing machine has a lower arm and an arm, at least one of which being pivotable.

BRIEF DESCRIPTION OF THE DRAWINGS

Further advantages and features of the invention emerge from the following description of an exemplary embodiment with the aid of the drawing. In the drawing:

FIG. 30 shows a long-sleeved shirt, FIG. 31 shows a plan view of a sleeve which is to be sewn to a cuff, FIG. 32 shows a side view of the workpieces to be sewn together, along the line XXXII—XXXII in FIG. 31, FIG. 33 shows a plan view corresponding to FIG. 31, with a joining seam having already been partially sewn, FIG. 34 shows an area from the view in FIG. 32, with the outer clamp in a different working position, FIG. 35 shows a view corresponding to FIGS. 31 and 33, with the joining seam having been completed.

DETAILED DESCRIPTION OF A PREFERRED EMBODIMENT OF THE INVENTION

Figure 1:
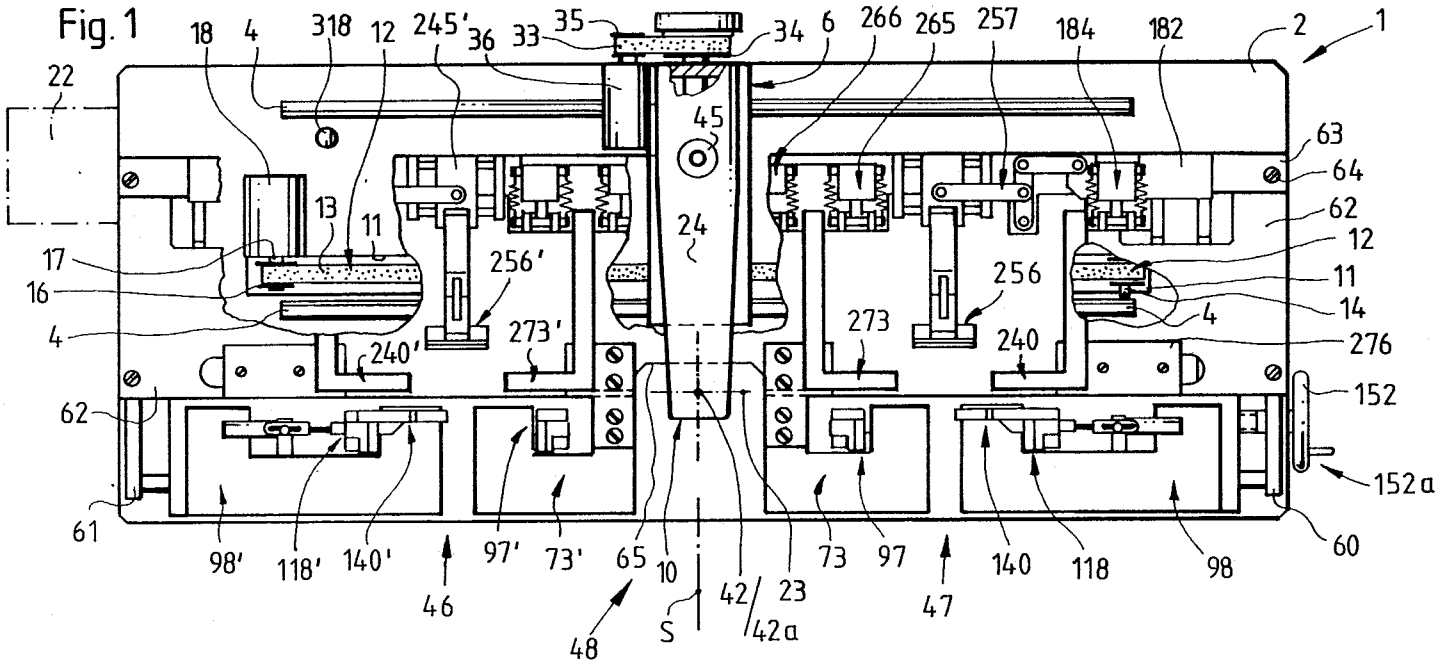
FIG. 1 shows a plan view, partially cut away, of an automatic sewing device according to the invention.

The automatic sewing device 1 has a stand 2, on the upper surface 3 of which two parallel guide rods 4 extending in the longitudinaal direction of the stand 2 are mounted on posts 5. A carriage 6, to the plate 9 of which a sewing machine 10 is attached, is slidably supported on the guide rods 4 by means of bearings 7 and 8.

Figure 3:
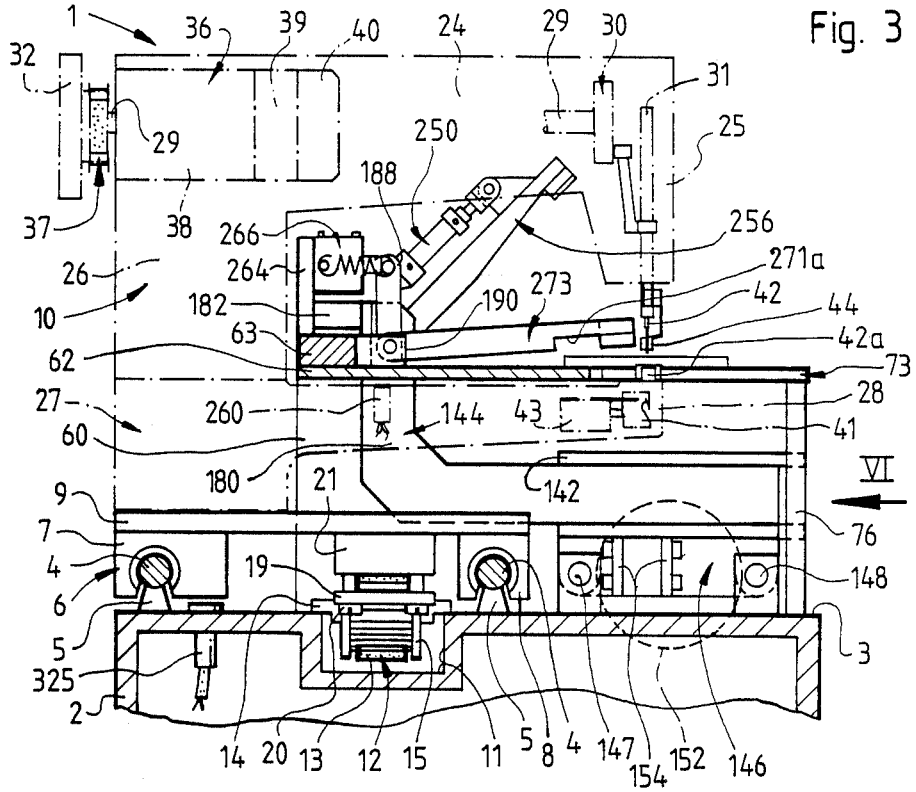
FIG. 3 shows a side view of the automatic sewing device in the direction of arrow III in FIG. 2.

As shown in FIGS. 1 and 3, the stand 2 has a recess 11 which extends longitudinally and thus also parallel to the guide rods 4 and in which a synchronous belt drive 12 is arranged. The latter consists of a toothed belt 13, a roller 15 rotatably mounted on the stand 2 by means of an axle 14 and a drive wheel 16 which is profiled to correspond to the profile of the toothed belt 13 and which is mounted on the shaft 17 of a drive motor 18. The axle 14 or the drive motor 18 are mounted in the longitudinal direction of the stand 2 so as to be adjustable thereon and to enable tensioning of the toothed belt 13. As shown in FIG. 3, the upper side or run (not designated in detail) of the toothed belt 13 is firmly clamped with the aid of a cover plate 19 and a screw 20 against a shoulder 21 which is attached to the underside of the plate 9 of the carriage 6. The drive motor is in the form of a stepping motor and is connected to an electronic control 22 so that it can be triggered thereby. Upon appropriate triggering of the drive motor 18, the carriage 6 is moved back and forth with the sewing machine 10 in the longitudinal direction of the stand 2 along the line 23.

The sewing macnhine 10 normally has a horizontal arm 24 which can be seen in FIG. 3 and the free end of which ends in a head 25 and the other end of which terminates in a standard 26 which forms an approximate right angle to the arm 24, i.e. it extends in a vertical direction. The end of the standard 26 is rigidly connected to a lower arm 27, the free end 28 of which has a cylindrical cross-section. Mounted in the arm 24 is an arm shaft 29 which terminates in the head 25 and, through a crank drive 30, drives a needle bar 31 slidably mounted in the head 25 with a reciprocating motion. That end of the shaft 29 facing the standard 26 bears a handwheel 32 which is provided with a timing belt pulley 34 receiving a timing belt 33. The timing belt 33 is, on the other hand, guided via a drive wheel in the form of a timing belt pulley 35 in a sewing machine drive 36. According to FIGS. 1 and 3, this drive is rigidly mounted on the arm 24 of the sewing machine 10. The timing belt 33 and timing belt pulleys 34, 35 form a timing belt drive 37 with a fixed transmission ratio. The sewing machine drive 36 has a motor component 38, a tachometer 39 and a position transmitter 40. Inside the standard 26 there are elements (not shown) for rotatably driving a hook 41 rotatably mounted in the free end 28 of the lower arm 27. The hook 41 cooperates with a needle 42 inserted in the lower end of the needle bar 31, this needle penetrating into a tubular stud **42*a* arranged on the lower arm 27 approximately above the hook 41. A thread cutter 43 is also provided in the area of the hook 41. To assist reliable stitch formation the needle 42 is surrounded by a presser foot 44. The line 23 represents the line of movement of the needle 42. The sewing machine 10 is designed to produce a two-thread lock stitch, for which purpose the hook 41 carries a hook thread supply (not shown) and for which purpose a needle thread supply 45 is arranged on the arm 24. To control the sewing machine 10 the sewing machine drive 36 and the thread cutter 43 are connected to the control system 22** via lines (not shown).

As shown in FIG. 1, the automatic sewing device 1 is mounted essentially symmetrically with respect to a vertical plane of symmetry S which centrally intersects the sewing machine 10 in its inoperative position. To the left of this plane of symmetry S there is arranged a left workpiece holder 46 and, to the right of this plane of symmetry S, a right workpiece holder 47. The two workpiece holders 46 and 47 form a workpiece holding device 48. Because of the symmetrical arrangement of the two workpiece holders 46,47, only the right workpiece holder 47 is described below.

For a better understanding of the remaining description, reference is made to the view of a shirt 49 in FIG. 30 which has a right sleeve 50 and a left sleeve 51. At the end of the right sleeve 50 there is a right cuff 52, and at the end of the left sleeve 51 there is a left cuff 53. The right sleeve 50 and right cuff 52 are joined together by a seam 54, and the left sleeve 51 and left cuff 53 by a seam 55. Each of the sleeves 50, 51 has at the end a slit associated with sleeve plackets 56,57, respectively.

The design of sleeves 50, 51 of this kind with slits serves to enable a shirt 49 to be put on. As shown in FIG. 30, a so-called material fullness of the sleeves 50, 51 is fitted in the area of the associated cuffs 52, 53 by at least one pleat 58, 59 in each case. As stated previously, the sleeves 50, 51 are tubular workpieces whereas the cuffs 52, 53 are pocket-shaped workpieces, the two layers of which are joined together by a seam **54*a* or 55*a*** on their three outlying edges. Even more precise details are given further on in the description.

Mounted on the upper surface 3 of the stand 2 are a right web and a left web 60, 61, on the upper side of which rests a supporting plate 62. The thickness of this plate is approximately equal to the length of the tubular stud **42*a*. According to FIGS. 1 and 3, immediately in front of the standard 26 of the sewing machine 10 a supporting beam 63 is secured on the upper side of the supporting plate 62 by screws 64, which supporting beam extends over the entire width of the automatic sewing device in the same manner as the supporting plate 62**.

Figure 2:
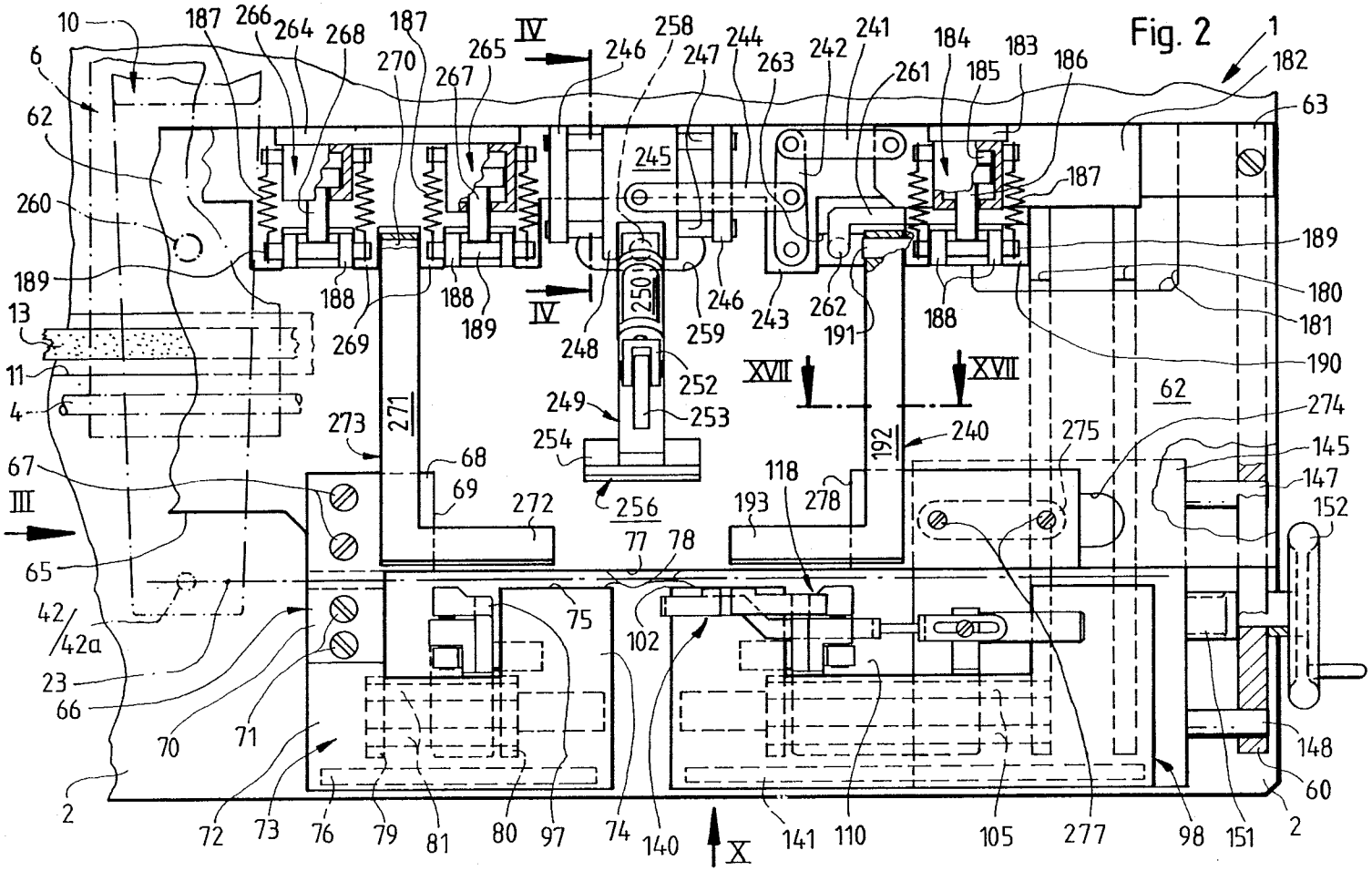
FIG. 2 shows a partial plan view of the automatic sewing device showing the right-hand part of FIG. 1.

As shown in FIG. 2, the central area of the supporting plate 62 is provided with a recess 65. An angular connecting piece 66 is fastened to the supporting plate 62 by screws 67. One side 68 of the connecting piece 66 has a positioning edge 69. Another side side 70 of the connecting piece 66 is fastened by screws 71 to a side 72—the left side in FIG. 2—of a U-shaped plate 73, the right side 74 of which has an edge 75. As is shown in more detail in FIG. 16, the plate 73 is connected, on its web (not designated in detail) connecting the sides 72, 74, rigidly to the stand 2 via a support 76. By means of the previously described arrangement of the supporting plate 62 and the plate 73 attached thereto by the connecting piece 66, the edge 75 and an edge 77 of the supporting plate 62 define a slot 78. The width of the slot 78 is dimensioned such that it is equal to the diameter of the tubular stud **42*a*, plus a tolerance of approximately 0.5 mm. The positioning of the slot in the plane of FIGS. 1 and 2 is such that its centre line corresponds to the path of the line 23. It is thus ensured that the tubular stud 42***a* can run freely along the slot 78 during movement of the sewing machine 10.

Below the U-shaped plate 73 there are provided two webs 79 and 80 which extend downwardly and in which there are mounted two guide rods 81 arranged parallel to the line 23. Slidably guided on the guide rods 81 is a sliding bearing 82 which is connected to a piston rod 83 of a clamp displacing drive 84 which is mounted in the web 80 and can be pneumatically operated with a double action. The sliding bearing 82 is provided with an arm 85 which projects into the space 86 defined by the two sides 72 and 74. The arm 85 is provided with a bearing 87 in which a shaft 88 is rotatably mounted. Attached to one end of the shaft 88 is a drive lever 89 which is connected via a sliding joint connection 90 to a clamp closing driver 91 which is in the form of a single-acting pneumatic piston/cylinder drive.

Figure 16:
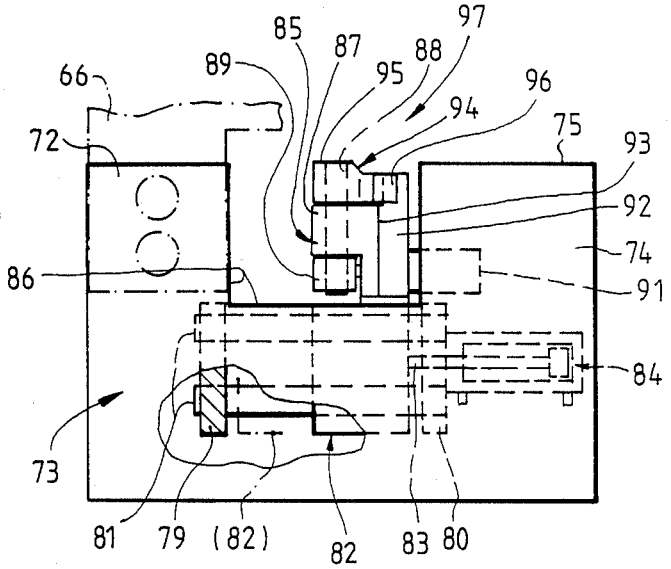
FIG. 16 shows a view of a sleeve clamp in the direction of arrow XVI in FIG. 6.

The arm 85 is also provided with a supporting surface 92 which is positioned at the same height or level as the upper side of the supporting plate 62. In the direction of the bearing 87 the supporting surface 92 is defined laterally by a positioning edge 93. The free end of the shaft 88 is connected to a one-sided lever 94 which, in the area where it is attached to the shaft 88, has a positioning edge 95 and the free end 96 of which combines with the supporting surface 92 to form an inner sleeve clamp 97. Appropriate pneumatic operation of the clamp displacing or closing drive 84 and 91 makes it possible to close the sleeve clamp 97 and move it in this condition into a different position indicated by chain-dotted edges of the sliding bearing 82 (FIG. 16).

Figure 11:
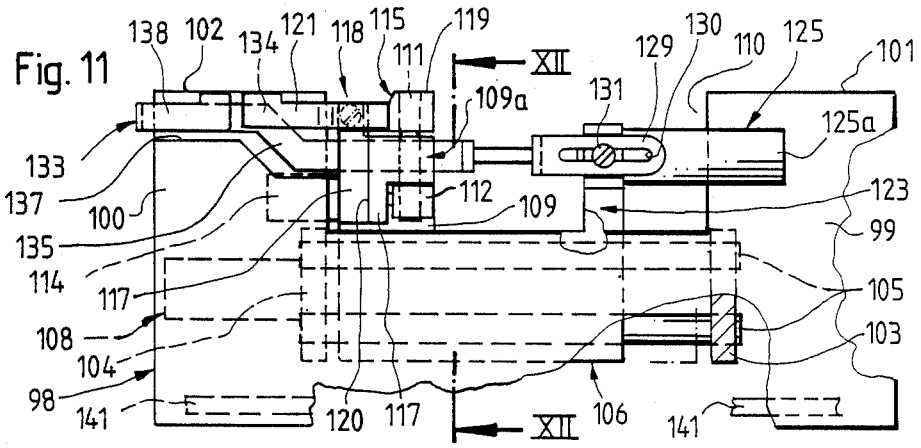
FIG. 11 shows a plan view of the folding device in the direction of arrow XI in FIG. 10.
Figure 12:
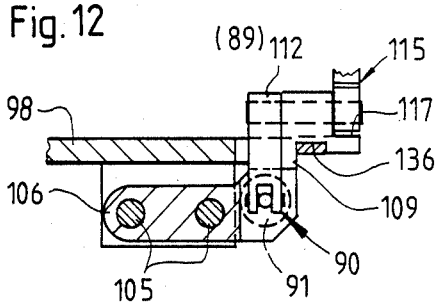
FIG. 12 shows a sectional view along the line XII—XII in FIG. 11.
Figure 13:
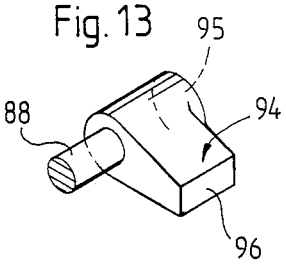
FIG. 13 shows a perspective enlarged view of a component shown in FIG. 12.

Another U-shaped plate 98 has a right side and a left side 99, 100, respectively, which are delimited by upper edges 101, 102. The edges 101 and 102 are parallel and equidistant from the line 23 and thus combine with the edge 77 of the supporting plate 62 to define an extension of the slot 78 (FIGS. 2 and 11).

Figure 10:
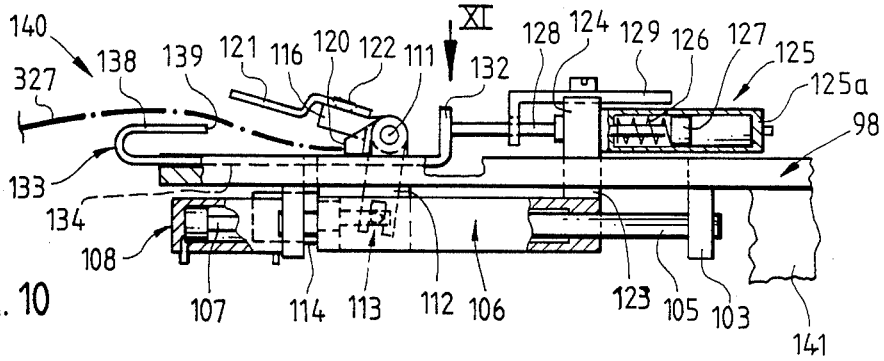
FIG. 10 shows a front view of a folding device in the direction of arrow X in FIG. 2.
Figure 14:
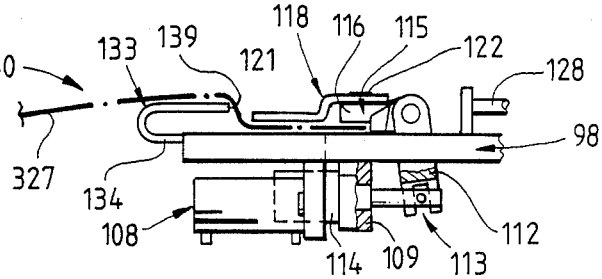
FIG. 14 shows the folding device according to FIG. 10, but in a different working position.

Similar to the plate 73, the plate 98 is provided on its underside with two webs 103 and 104 in which, in turn, two guide rods 105 are fixed. Slidably mounted on the guide rods 105 is a slide bearing 106 which, for driving purposes, is rigidly connected to the piston rod 107 of a clamp displacing drive 108 which is mounted in the web 104 and is in the form of a double-acting pneumatically operated piston/cylinder drive (FIGS. 10, 11, 14). The sliding bearing 106 is provided with an arm 109 which projects into a space 110 defined by the sides 99 and 100. Also, the arm 109 is provided with a bearing 109*a* which corresponds to the bearing 87 and in which a shaft 111 is rotatably mounted. A free end of the shaft 111 is connected to a drive lever 112 which is identical to the drive lever 89. The drive lever 112 is in turn connected through a sliding joint connection 113, which corresponds to the linkage 90, to a clamp closing drive 114 which is in the form of a single-acting pneumatic cylinder and which corresponds in design to the clamp closing drive 91. The closing drive 114 is in turn rigidly attached to the arm 109 of the sliding bearing 106. Rigidly connected to the other end of the shaft 111 is a lever 115, the free end 116 of which combines with a supporting surface 117 provided on the arm 109 to form an outer sleeve clamp 118. Similarly to the lever 94 which is also provided with a positioning edge 95, the lever 115 also has a positioning edge 119. In addition, the supporting surface 117 is defined by a positioning edge 120 in the same way as the supporting surface 92 is delimited by a positioning edge 93.

Figure 15:
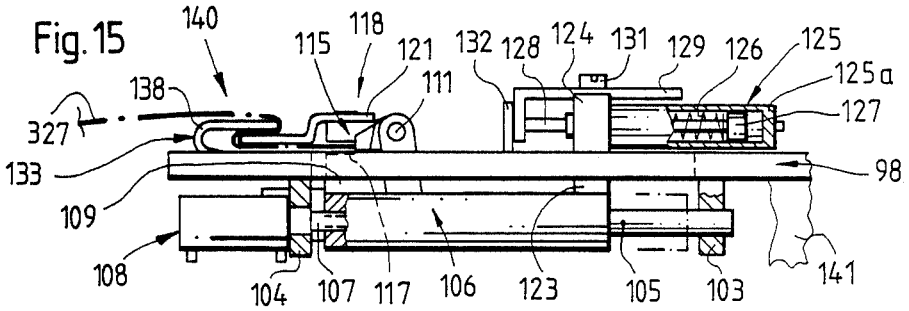
FIG. 15 shows the folding device according to FIG. 10 in another working position.

A folding arm 121 is fastened to the free end 116 of the lever 115 by a screw 122. As is also shown in FIGS. 10, 11 and 15, there is provided on the sliding bearing 106 a support 123, the free end 124 of which projects into the space 110. Connected to the free end 124 of the support 123 is a pneumatically operated folding drive 125, the cylinder 125*a* of which contains a compression spring 126 and a piston 127 with a piston rod 128. Also, a stop 129 in an oblong hole 130 is secured to the free end 124 of the support 123 by a screw 131. The free end of the piston rod 128 is connected to an offset end 132 of a fold puller 133. The fold puller 133 has a central part 134 with a bent section 135 as shown in FIG. 11. A shown in FIG. 12, the arm 109 is also provided with a channel 136 having the shape of an inverted U. The central part 134 is fitted in this channel 136 whilst the bent section 135 is accomodated in a recess 137 provided in the plate 98. The fold puller 133 is further provided with a bent-over end 138 which terminates in a folding edge 139. The previously described components, such as the folding arm 121, the fold puller 133, the fold drive 125 and the stop 129, form a folding device 140 (FIGS. 10, 11, 12, 14, 15).

Figure 6:
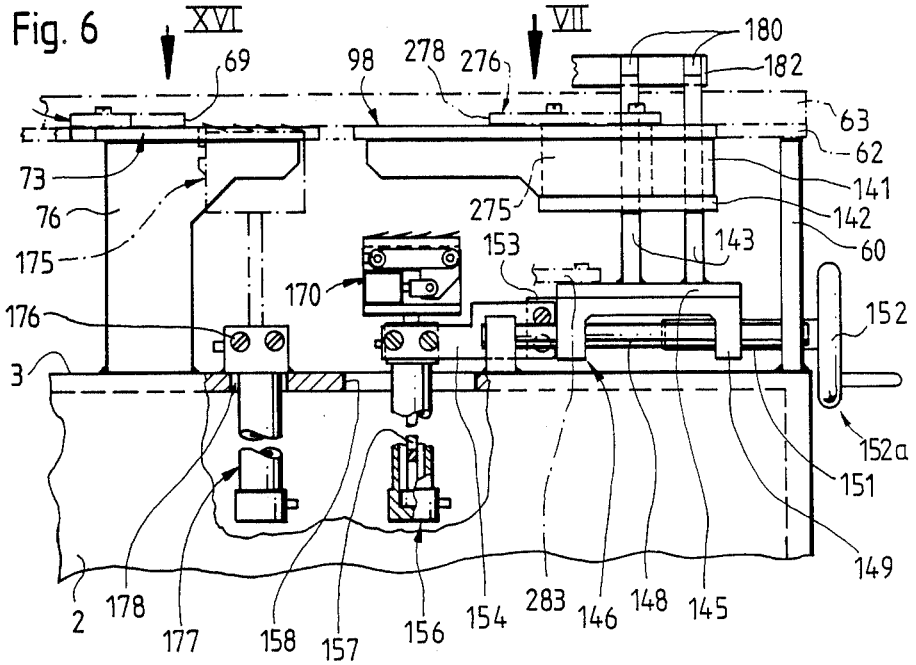
FIG. 6 shows a partial front view of the automatic sewing device in the direction of arrow VI in FIG. 3.
Figure 7:
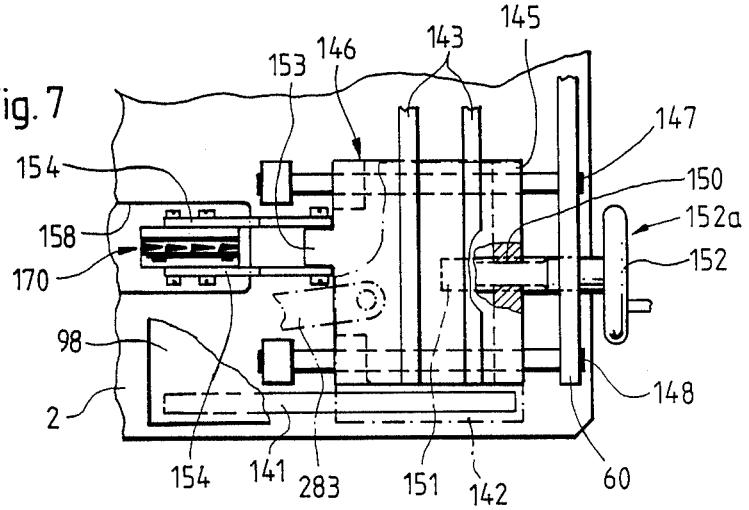
FIG. 7 shows a plan view of the part of the automatic sewing device shown in FIG. 6, in the direction of arrow VII in FIG. 6.

The plate 98 is mounted with its underside on a support 141 which in turn is supported again on an intermediate plate 142 arranged parallel to the supporting plate 62. This intermediate plate is further supported by the relatively long legs 143 of two angles 144 which are welded to a plate 145. The plate 145 forms part of a slide plate 146 which is slidably guided on guide rods 147 and 148 in bearings in the longitudinal direction of the stand 2 and thus also parallel to the line 23. Approximately halfway between the two guide rods 147 and 148, a bearing rib 149 of the slide plate 146 is provided with a thread 150 in which a threaded spindle 151 is received with a rotary motion. This threaded spindle is also mounted in the right web 60 so as to be axially non-slidable, but rotatable, and is provided with a hand crank 152 at its end projecting out of the profile of the stand 2 (FIGS. 6 and 7). It forms a size adjustment device 152*a*.

The slide plate 146 is further provided with a projection 153 to which two support arms 154 are screwed tightly by screws (not designated). A cuff-holder main drive 156 is attached to the free ends of the support arms 154 by screws 155, the longitudinal axis of this main drive extending vertically, i.e. at right angles to the upper surface 3 of the stand 2. The main drive 156 is in the form of a double-acting pneumatic cylinder and, as a special feature, has a piston rod 157 with a square cross-section, hereby ensuring that components attached thereto cannot rotate about the longitudinal axis of the piston rod 157. As is also shown in FIGS. 6 and 7, the cuff-holder main drive 156 projects into the stand 2 which is in the form of a hollow body, for which purpose the upper surface 3 of this stand is provided with a rectangular recess 158. The recess 158 is dimensioned in such a way that, when the hand crank 152 of the adjusting device 152*a* is turned, the cuff-holder main drive 156 connected to the slide plate 146 can be moved freely.

Figure 8:
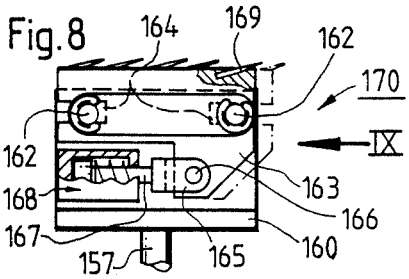
FIG. 8 shows an enlarged partial view from FIG. 6.
Figure 9:
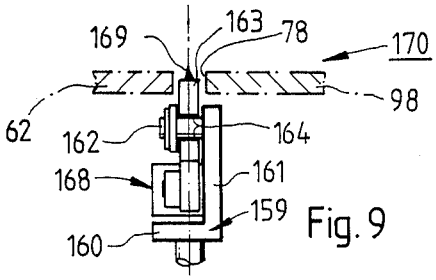
FIG. 9 shows a partial side view in the direction of arrow IX in FIG. 8.

The short leg 160 of an unequal angle 159 is attached to the upper free end of the piston rod 157 of the main drive 156. The other long leg 161 of the angle 159 extends eccentrically, but parallel to the longitudinal extension of the piston rod 157. Mounted on one side of the long leg 161 are two pins 162 on which a needle carrier 163 is arranged slidably in a plane parallel to the upper surface 3 of the stand 2, for which purpose the pins 162 extend through slot-like recesses 164 in the needle carrier 163. In the axial direction of the pins 162, the needle carrier 163 is retained on the pins 162 by an axial locking means (not designated in detail). According to FIG. 8 the needle carrier 163 is flexible connected to a connecting element 165 via a bolt 166. The connecting element 165 is connected to the piston rod 167 of a needle carrier drive 168 which is in the form of a single-acting pneumatic cylinder with an integrated compression spring. Also the upper side of the needle carrier 163 is provided with needles 169 which are positioned in such a way that their longitudinal axes run obliquely upward towards the supporting plate 62 at an acute angle of less than 10° relative to the horizontal supporting plate 62. Upon actuation of the needle carrier drive 168, the needle carrier 163 is moved from the position shown by unbroken lines in FIG. 8 into the position shown by dot-dash lines, the needle carrier 163 being displaced in the direction of the needle points parallel to the supporting plate 62. Upon actuation of the cuff-holder main drive 156 with compressed air on the side remote from the piston rod side, the needle carrier 163 can be moved with its needles 169 into a raised position, the needle carrier 163 being moved with play into the slot 78. Because the longitudinal axis of the main drive 156 and the line 23 intersect, the needles 169 are as a result moved into the centre of the slot 78. In this raised position the points (not designated in detail) of the needles 169 project over the upper side of the supporting plate 62 so that upon appropriate operation of the needle carrier drive 168, penetration of the needles 169 into the laid-open cuff 52 is ensured. The previously described unit, which consists essentially of the needle carrier 163 with the needles 169 and the associated drives 168 and 156, is referred to in the following description as the lower outer cuff holder 170.

As can be seen from FIG. 6, an inner cuff-holder 175 is fastened to the stand 2 by screws 176, this holder being shown by dot-dash lines in its raised and horizontally displaced position. The inner cuff holder 175 corresponds in its design to the outer cuff holder 170 and is arranged symmetrically with respect to this outer cuff holder. Its cuff-holder main drive 177 extends through an opening 178 into the stand 2.

Each of the angles 144 has a shorter leg 180 which extends upwardly in FIG. 3 and each of which projects through a recess 181 (FIG. 2) in the supporting plate 62. The ends of the legs 180 are rigidly connected to a carrier 182 which, according to FIG. 3, runs above the supporting beam 63 and, similar to the latter, has a rectangular cross-section. On the carrier 182 there is formed a web 183 to which is attached a clamp tilt drive 184 in the form of a single-acting pneumatic cylinder. Arranged inside the clamp tilt drive 184 is a spacer 185 which acts as a stroke arresting device and thus prevents the piston rod 186 from being able to occupy a fully retracted position. The clamp tilt drive 184 is further provided with two outer tension springs 187 which cause a rod 189 provided in an off-drive lever 188 to be constantly in contact with the piston rod 186. The carrier 182 is also provided with a bearing 190 in which the off-drive lever 188 rigidly connected to a shaft 191 is pivotably mounted.

According to FIG. 2 a one-armed angle lever 192 is mounted on the end of the shaft 191. Its offset part 193 projects into the area of the edge 77 of the supporting plate 62 and extends approximately parallel to the edge 77. Details are described below in connection with FIGS. 17 to 21.

The box-shaped offset part 193 has two side walls 194, **194*a*, one end of which is tightly screwed by a screw 195 to that other part 196 of the angle lever 192 which leads to the shaft 191. The free end of the side wall 194 is connected to an angle 197 which in turn extends, according to FIG. 18, parallel to the other part 196 and which is pierced by a threaded bore 198. The offset part 193 also has a cover plate 200 which is fastened by screws 199 and which receives a set screw 201, passing through the cover plate 200**, in a thread (not designated).

Figure 17:
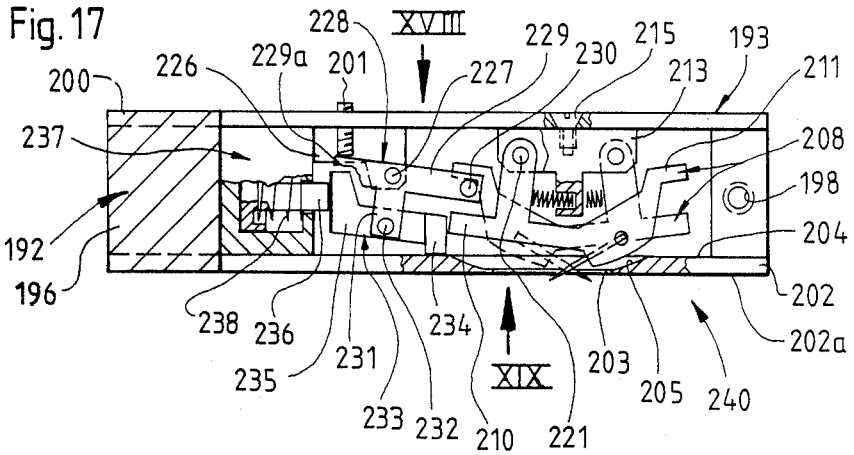
FIG. 17 shows a sectional view of an outer clamp along the line XVII—XVII in FIG. 2.
Figure 19:
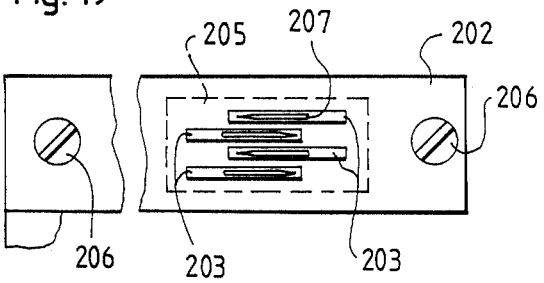
FIG. 19 shows a plan view of a bottom plate of the outer clamp in the direction of arrow XIX in FIG. 17.
Figure 20:
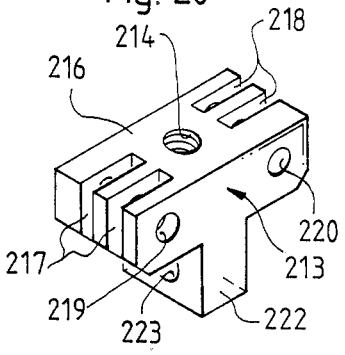
FIG. 20 shows a perspective view of an outer clamp component shown in FIG. 17.
Figure 18:
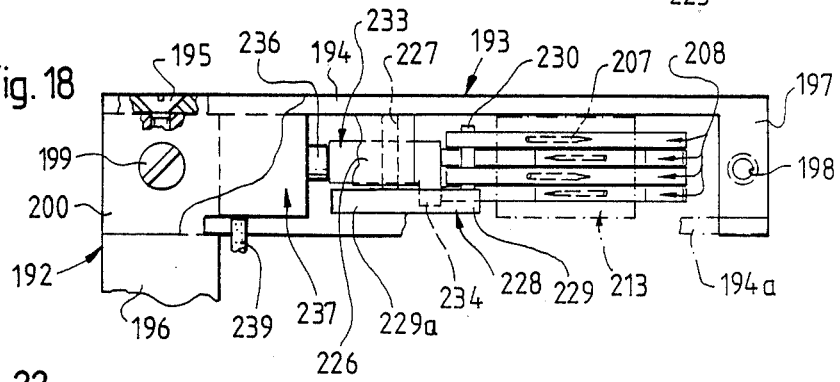
FIG. 18 shows a plan view of the outer clamp in the direction of arrow XVIII in FIG. 17.
Figure 21:
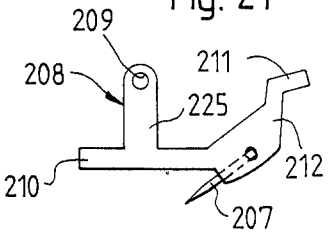
FIG. 21 shows a view of a double-armed T-lever shown in FIG. 17.

The offset part 193 also has a bottom plate 202 which is secured by screws 206 and extends parallel to the cover plate 200. The bottom plate 202 has four slot-like rectangular recesses 203 which are parallel to the longitudinal direction of the part 193 and which are arranged side by side in a longitudinally staggered relationship to one another. In the area of these recesses 203 the bottom plate 202 is provided with a cavity 205 which is open towards its inner side 204. It is possible in FIG. 19 to see in the recesses 203 needles 207 which are not rigidly connected to the bottom plate 202. As shown in FIGS. 17 and 21, each of the needles 207 on the contrary forms part of a double-armed T-lever 208 which, starting from a central arm 225 having a bearing bore 209 at its free end, has a lever arm 210 and lever arm 212 which carries the needle 207 and an offset end 211.

Figure 22:
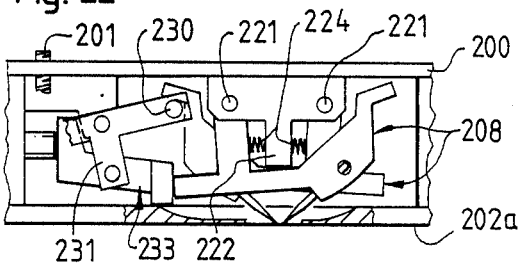
FIG. 22 shows a partial representation of the outer clamp in a view corresponding to FIG. 17, but in a different working position.

According to FIG. 17 a bearing 213 is fitted on the inner side of the cover plate 200. It has, according to FIG. 20, a T-shaped cross-section and is screwed to the cover plate 200 by a screw 215 screwed into a threaded bore 214. Also, at the ends of its upper cross web 216, the bearing 213 is designed with slots 217 or 218 which are in turn in a staggered arrangement relative to one another. In the area of the slots 217, 218 the cross web 216 is penetrated by bores 219, 220. The slots 217 and 218 are dimensioned in width in such a manner that they receive the central arms 225 of the double-armed lever 208 with play, the bores 219 and 220 each having a bearing pin 221 which passes through the bearing bores 209 of the T-levers 208 with play. The bearing 213 is provided with blind holes 223 on its central web 222. These blind holes 223 are associated with the slots 217 or 218 so that compression springs 224 received therein can engage on the central arms 225 of the double-armed T-levers 208. As shown in FIGS. 17 and 22, the double-armed T-levers 208 are mounted in the slots 217 and 218 in pairs and in fitting positions which are symmetrical with respect to one another.

Attached to the inner side of the cover plate 200 is another bearing 226 in which a T-shaped lever 226 is pivotably mounted by means of a bolt 227. An arm 229 of the lever 228 bears a pin 230, which projects under the ends 211 of two adjacent double-armed T-levers 208. The web 231 of the lever 228 is flexibly connected to a double-armed thrust lever 233 via another pin 232. An arm 234 of this thrust lever 233 lies with its offset end supported against the faces of the two adjacent lever arms 210 whilst the other arm 235 bears with its offset end against a piston rod 236 of a needle drive 237. The needle drive 237 is in the form of a single-acting pneumatic cylinder having an integrated compression spring 238, compressed air being supplied to this cylinder via a hose 239.

By comparing FIGS. 17 and 22 it can be seen that the double-armed T-levers 208 with their needles 207 are staggered in such a manner that, on the one hand, they are pivoted into an inoperative position flush with the underside 202a of the bottom plate 202 by operating the needle drive 237 (FIG. 22), or that, on the other hand, they can be pivoted into a position which intersects and thus into a position for penetrating the underside 202a of the bottom plate 202, by the force of the compression springs 224 on reducing the pressure on the needle drive 237 (FIG. 17). The set screw 201 serves as an adjustable stop for the free lever arm 229a of the lever 228 to adjust the extended position of the needles 207 (FIG. 22). The angle lever 192 which can be pivoted by means of the clamp tilt drive 184 combines with its part 193 having the pivotable needles 207 to form an outer clamp 240.

Figure 4:
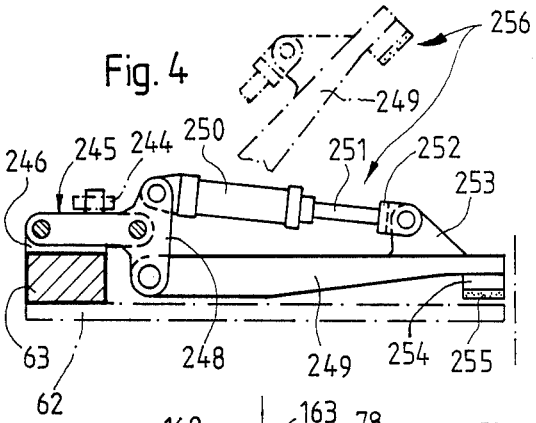
FIG. 4 shows a partial sectional view along the line IV—IV in FIG. 2.

According to FIG. 2 an articulated lever 241 is pivotably mounted on the carrier 182, its free end being flexibly connected to a lever 242. The lever 242 in turn is flexibly connected to a projection 243 of the supporting beam 63. A tie rod 244 is articulated on the lever 242 centrally in relation to the linkages of the articulated lever 241 and the projection 243, the other end of this tie rod being flexibly connected to a sliding bearing 245. The sliding bearing 245 is slidably mounted on two guide rods 247 attached to webs 246 of the supporting beam 63. As can be seen from FIGS. 4 and 5, the sliding bearing 245 has a bearing web 248 on which a lever 249 and a central clamp tilt drive 250 in the form of a double-acting pneumatic cylinder are articulated. The piston rod 251 of the tilt drive 250 is articulated on a bearing web 253 of the lever 249 by way of a forked part 252. The lever 245 is also provided at its free end with a cross web 254 which is bonded to a friction lining 255 on its side facing the supporting plate 62. The cross web 254 with the friction lining 255 serves to clamp a workpiece, for example in the form of the cuff 52, firmly against the supporting plate 62 upon actuation of the tilt drive 250. The previously mentioned components, namely the lever 249 with the cross web 254 and friction lining 255 and the tilt drive 250, form a central clamp 256. The driving linkage which comprises essentially the articulated lever 241, the lever 242 and the tie rod 244 is referred to below as the dividing gear 257.

Figure 5:
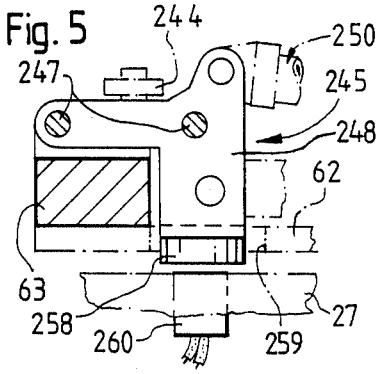
FIG. 5 shows an enlarged detail from FIG. 4.

As can be seen in FIG. 5, the bearing web 248 of the sliding bearing 245 is provided with a permanent magnet 258 which projects downwardly through a recess 259 in the supporting plate 62. The permanent magnet 258 cooperates with a sensor 260 arranged on the lower arm 27 of the sewing machine 10. According to FIG. 2 the carrier 182 is provided with an arm 261 which carries another permanent magnet 262 at its end. This permanent magnet 262 extends downwardly through a further recess 263 in the supporting plate 62 and also cooperates with the sensor 260 when the sewing machine 10 is in an appropriate position. In both cases signals which are dependent on the position of the sewing machine 10 are generated.

As can be further seen from FIG. 2, there is provided on the supporting beam 63 another web 264 which is comparable with the web 183 and to which two pneumatic clamp tilt drives 265 and 266 are attached. The tilt drive 265 corresponds in its design to the tilt drive 184, but its cylinder does not contain a stroke-limiting spacer 185. The tilt drive 266 corresponds in design to the tilt drive 265. Compared with the tilt drive 265, it has only half the stroke of this drive. The piston rods 267 and 268 of the tilt drives 265 and 266 each bear against a rod 189 which is identical in construction to the rod 189 and, accordingly, also has the same reference numeral. The carrier 182 is also provided with bearings 269 which, in their arrangement, correspond to the bearing 190. Rotatably mounted in the bearings 269 is a shaft 270 which is non-rotatably connected to off-drive levers 188 which, in their structural form, correspond to the off-drive lever 188 and are therefore provided with the same reference numerals. In the same way as the tilt drive 184, the tilt drives 265, 266 are also equipped with the already mentioned tension springs 187 which ensure that the rods 189 remain in contact with the piston rods 267, 268, or cause the tilt drives 184, 265 and 266 to occupy their inoperative positions with piston rods 186, 267, 268 retracted when pressure is relieved.

A lever 271 is arranged with its free end pivotable between the bearings 269 and is rigidly connected to the shaft 270. The lever 271 is designed as a mirror image with respect to the lever 192 and accordingly has an offset part 272. A mirror-inverted arrangement of components as shown in FIGS. 17 to 22 is also fitted inside this offset part 272. The layer 271 with its offset part 272 and the tilt drives 265, 266 forms an inner clamp 273 for the cuff 52.

As can also be seen from FIG. 2, the supporting plate 62 is provided with a further long opening 274 through which a projection 275 on the intermediate plate 142 extends with play. A plate 276 is secured on the end of this projection extending through the supporting plate 62 by screws 277. The plate 276 rises a few millimeters above the supporting plate 62. The plate 276 has a positioning edge 278 for the cuff 52 and forms an adjustable stop for the cuff 52.

Figure 23:
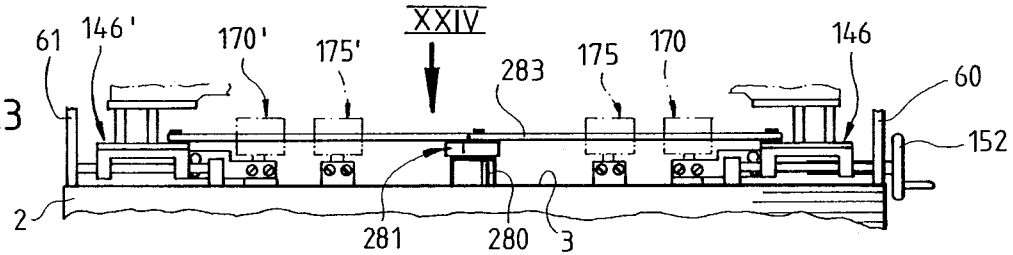
FIG. 23 shows a front view of an area of the automatic sewing deviee in the direction of arrow X in FIG. 2.
Figure 24:
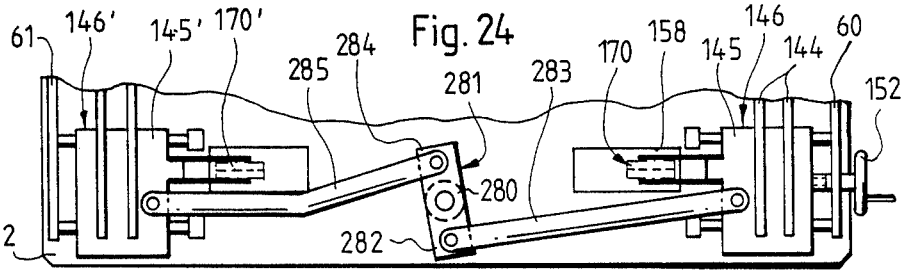
FIG. 24 shows a plan view of the area shown in FIG. 23, in the direction of arrow XXIV in FIG. 23.

As shown in FIGS. 23 and 24, a bearing shoulder 280 on which a two-armed lever 281 is rotatably mounted is formed on the upper surface 3 of the stand 2. An arm 282 of the lever 281 is flexibly connected to an end of the tie rod 283, the free end of which is articulated on the plate 145. The other arm 284 of the lever 281 is flexibly connected to an offset tie rod 285, the free end of which is articulated on a plate 145'. It can be seen from the example of the plate 145 or 145' that the sewing machine 1 has parts which are identically designed, but are mirror-inverted, the reference numerals which are provided with an ' referring to respective elements of the left workpiece holder 46. As a rule there is no separate description.

The plate 145' forms part of a slide plate 146' on which a lower outer cuff holder 170' in turn is arranged with a mirror-inverted design with respect to the slide plate 146. As is also shown in FIG. 23, the cuff holder 175 is associated, in a mirror-image arrangement, with an inner cuff holder 175' on the stand 2.

Figure 26:
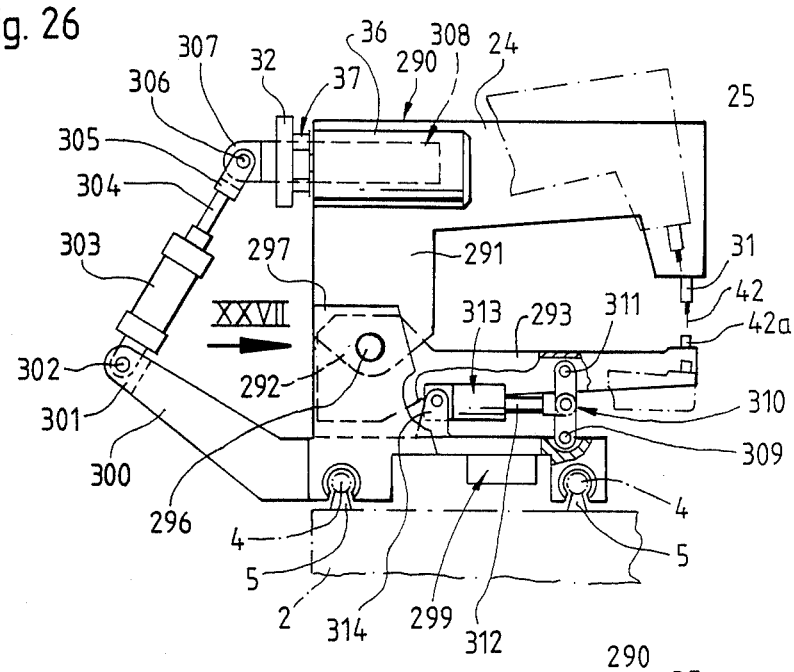
FIG. 26 shows a side view of a modification of the sewing machine, corresponding to the view in FIG. 3.
Figure 27:
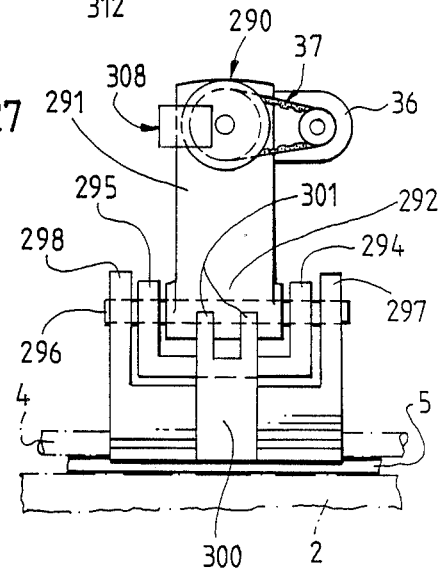
FIG. 27 shows a back view of the sewing machine shown in FIG. 26, in the direction of arrow XXVII in FIG. 26.

In the event of the slot 78 being closed on the side adjacent to the sewing machine 10 for reasons of stability, the arm 24 and the lower arm 27 must be pivotable in an upward or downward direction. Such an embodiment of a sewing machine 290 used in the automatic sewing device 1 is shown in FIGS. 26 and 27. With the sewing machine 10 identical parts have identical reference numerals so that the description is not repeated.

The standard 291 terminates in a bearing 292. The sewing machine 290 is also provided with a lower arm 293 which has two bearing ribs 294 and 295 at its U-shaped end facing the standard 291. The bearing ribs 294 and 295 and the bearing 292 of the standard 291 are penetrated by an axle 296 so that the lower arm 293 is pivotable relative to the arm 24. The free ends of the axle 296 are received by ribs 297 and 298 which form part of a carriage 299. The carriage 299 is also provided with an arm 300, the forked end 301 of which supports an end of an arm tilt drive 303 by way of a bolt 302. This drive is in the form of a double-acting pneumatic cylinder and has a fork-shaped piece 305 at the free end of its piston rod 304. This fork-shaped piece is articulated on an end 307 of an arm 308 with the aid of a pin 306. The free end of the arm 308 is attached to the arm 24.

According to FIG. 26 there is formed on the carriage 299 a pivot bearing 309 in which a toggle lever mechanism 310 consisting of two levers is supported. This mechanism 310 is on the other hand flexibly connected to the lower arm 293 via a link 311. The mechanism 310 is also connected flexibly to the piston rod 312 of a lower arm tilt bearing 313 which in turn is flexibly supported in a plummer-block bearing 314 of the carriage 299.

Figure 28:
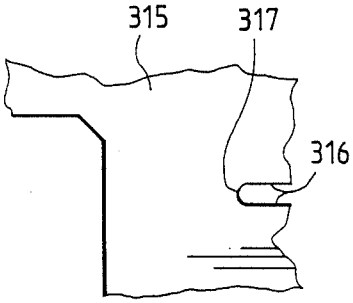
FIG. 28 shows a partial plan view of a modified embodiment of a workpiece holder.

FIG. 28 shows a section from a differently designed supporting plate in which the components shown in FIG. 2, such as the supporting plate 62 and the plate 73, are unified and form a supporting plate 315. In this case a a slot 316 which corresponds to the slot 78 and has a semicircular end 317 is cut into the supporting plate 315. In this connection the slot **31*b* is also closed on the side adjacent to the sewing machine 290 so that the sewing machine 290 is used. Details of the design of the sewing machine 290** can be obtained from the patent application filed by the applicant company on the same date of application under the title "Sewing head for a sewing machine, particularly an automatic sewing device".

The mode of operation of the automatic sewing device 1 is described below. First, the kinematic cooperation between the various components, which is important for the joint size adjustment of the left and right workpiece holders 46 and 47, shall be explained with the aid of FIG. 25.

The kinematic linkage of the sliding plate 146' to the slide plate 146 via the tie rods 283 and 285 and the two-armed lever 281 makes it possible for the slide plate 146' of the left workpiece holder 46 to be also adjusted symmetrically with respect to the plane of symmetry S when the slide plate 146 is adjusted by means of the hand crank 152. During such an adjustment the positions of the inner clamps 273 or 273' relative to the plane of symmetry S remain unchanged. The kinematic linkage between the slide plate 146 and the dividing gear 257 is produced by the angle 144. As a result of this linkage the outer clamp 240 attached to the angle 144 is displaced to the same degree as the slide plate 146, i.e. parallel to this slide plate, that is the outer clamp is positioned. The adjustable stop formed by the plate 176 and the positioning edge 278 is also adjusted together with the slide plate 146. As a result of the action of the dividing gear 257, an adjusting distance covered by the slide plate 146 and thus by the outer clamp 240 is halved so that the sliding bearing 245 supporting the central clamp 256 executes only half the degree of adjustment relative to the plane of symmetry S, compared with the outer clamp 240. This kinematic linkage ensures that the distance A of the axis of symmetry Sr of the central clamp 256 from the outer clamp is always equal to the distance B between the axis of symmetry Sr of the central clamp 256 and the inner clamp 273. The sum of the distances A and B is equal to the set size C of a cuff 52 which is to be inserted. The axis of symmetry Sr corresponds to the axis of symmetry (not designated in detail in this case) of each cuff 52 to be sewn.

The position of the inner clamp 273 fixed to the stand is not changed. The same applies to the positioning edge 69 which is at a fixed distance a from the plane of symmetry S. In contrast, the plate 276 with its positioning edge 278 can be displaced together with and to the same degree as the sliding plate 146. The same applies to the folding device 140.

The operation of the outer clamp 240 and the inner clamp 273 is explained below.

The inner clamp 273 can be pivoted into a lower position and a raised position by actuating the clamp tilt drive 265. In the lower position the offset part 272 then comes into contact with the supporting plate 62 or with the cuff 52 to be clamped which is positioned on the supporting plate 62 (FIG. 34). Because the lever 271 of the inner clamp 273 has a recess **271*a* (FIG. 3), a collision with the side 68 during the lowering of the inner clamp 273 is impossible. The mentioned design of the tilt drive 266 also makes it possible to move the inner clamp 273, in addition to the previously described positions, into a central position in which compressed air is then admitted only to the piston side of the tilt drive 266. This central position is shown in FIG. 3**.

In contrast to the inner clamp 273, the outer clamp 240 can be brought into a raised position and a lower position by appropriate operation of the clamp tilt drive 184. Then the lower position of the outer clamp 240 in turn corresponds to the lower position of the inner clamp 273 whilst the raised position of the outer clamp 240 corresponds to the previously described central position of the inner clamp 273. This position is attained because, despite the tilt drives 265 and 184 having the same dimensions, the stroke of the latter tilt drive is limited by the spacer 185. In order eliminate collision with the plate 276 when lowering the outer clamp 240, the latter is likewise provided with a recess corresponding to the recess **271*a***.

The switching on of the current supply for the control system 22 is followed by an adjusting or aligning operation which serves to bring the carriage 6 carrying the sewing machine 10 into a definite starting position relative to the stand 2. An adjusting operation of this kind is generally necessary when using stepping motors in order that the control system 22 may move the carriage 6 into defined positions. For this purpose the control system 22, following appropriate transmission of instructions, causes the carriage 6 to move to the left side (FIG. 1), i.e. into an extreme position in the direction of the left workpiece holder 46. As soon as a sensor 318 provided on the stand 2 is activated by the bearing 7 of the carriage 6, the control system 22 detects this position and subsequently moves the carriage 6 through appropriate triggering of the drive motor 18 by a preset distance towards the right workpiece holder 47 until the carriage 6 with the sewing machine 10 occupies the central position shown in FIG. 1. When in this position the needle 42 of the sewing machine 10 is situated in the plane of symmetry S.

As soon as the adjusting operation is completed, the inner clamp 273, central clamp 256 and outer clamp 240 occupy their starting positions. As a result the outer clamp 240 and central clamp 256 are in their raised position whereas the inner clamp 273 is in its central position (FIG. 3). When in these positions the needles 207 arranged in the offset parts 193 and 272 are in retracted positions as shown in FIG. 22. The sleeve clamps 97 and 118 are in their positions adjacent to one another and facing the axis of symmetry Sr. In addition, the folding device has occupied the position shown in FIG. 10 and the lower cuff holders 170 and 175 are in their positions remote from the supporting plate 62, the needles 169 at the same time occupying their retracted positions.

In this situation a right cuff 52 and a right sleeve 50 are inserted as workpieces into the right workpiece holder 47.

The cuff 52 is then aligned with the positioning edges 69 and 278 in the direction of the sewing line 23 and with the positioning edges 95 and 119 in a direction perpendicular thereto. Subsequently, the inner clamp 273 and the outer clamp 240 are moved into their lower positions so that the cuff 52 is firmly clamped on the supporting plate 62 by means of the undersides 202*a* of the bottom plate 202 of the offset parts 193, 272. Then triggering of each needle drive 237 causes the needles 207 to move out and be inserted in the upper cuff layer 325 facing the clamps 273 and 240 in an intersecting position according to FIG. 17 whereby this cuff layer is held. At the same time the cuff holders 170 and 175 are moved by operation of the cuff-holder main drives 156 and 177 into their upper position where they penetrate into the slot 78. Subsequent operation of the needle carrier drives 168 causes the needle carriers 163 to move away from one another whereby the needles 169 are each inserted into the lower cuff layer 326 in the direction of the positioning edges 69 or 278. Following the gripping of the upper and lower cuff layers 325, 326, respectively, caused by the insertion of the needles 207, 169, the outer clamp 240 and the inner clamp 273 are raised again and as a result return to their initial position. The two cuff layers 325, 326 are sewn together along their three outer edges by means of the seam 54*a*; the cuff is open only on the side which is to be joined to the sleeve 50 by means of the seam 54 (FIG. 32). The cuff 52 is therefore kept open in such a way that insertion of a border 327 of the sleeve 50 is possible. This border 327 is a marginal zone or area of the sleeve 50.

For this purpose the sewer first inserts a (left) lateral edge 328—which defines the slit opening—of the sleeve 50 drawn open on its lower border 327 into the inner sleeve clamp 97, the positioning edge 93 serving to align the lateral edge 328. Then, the border 327 of the sleeve 50 as shown in FIG. 10 is inserted on the fold puller 133, but under the folding arm 121, the other (right) lateral edge 329—which defines the border 327 on the slit—of the border 327 finally being applied to the positioning edge 120 of the outer sleeve clamp 118 and finally clamped. The clamping operations on the sleeve clamps 97 and 118 are performed by appropriate triggering of the associated clamp closing drives 91 and 114 after an appropriate instruction is given by the sewer.

The folding arm 121 is pivoted into the position shown in FIG. 14 by the triggering of the closing drive 114 of the outer sleeve clamp 118. After a predetermined dwell time has expired, the folding drive 125 evacuated of air so that the fold puller 133 is moved under the force of the compression spring 126 in such a manner that the bent-over end 138 of the fold puller is slipped over the folding arm 121 so that the fold 58 is formed with a material fullness on the border 327 of the sleeve 50. Finally, the offset end 132 of the fold puller 133 comes into contact with the stop 129. Adjustment of this stop 129 makes it possible to vary the depth of the formed fold 58.

Then the sewer transmits an instruction to the control system 22 to initiate the sewing operation. Following this instruction the control system 22 first causes the inner sleeve clamp 97 to be moved from the position shown in FIG. 31 towards the plane of symmetry S by appropriate operation of the clamp displacing drive 84. As a result the lateral edge 328, firmly clamped in the clamp 97, of the border 327 of the sleeve 50 is moved into the position shown in FIG. 33 in such a way that the lateral edge 328 is finally located in its ultimate position relative to the cuff 52. This is followed by a lowering of the inner clamp 273 and central clamp 256—also caused by the control system 22. For this purpose the clamp tilt drive 265 and the central clamp tilt drive 250 are operated accordingly. The cuff 52 is therefore clamped against the supporting plate 62 in the area of its centre line corresponding to the axis of symmetry Sr. In addition, it is clamped in the area of its left end against the supporting plate 62 by the inner clamp 273. When the inner clamp 273 is applied to the cuff 52, the needles 207 are drawn out of the upper cuff layer 325 by operating the needle drive 237. At the same time the needles 169 of both cuff holders 170, 175 are moved out of the lower cuff layer 326 by actuating the needle carrier drives 168 so that they can subsequently be moved down into their lower position by operation of the cuff-holder main drives 156, 177. As can be seen from FIG. 33 and particularly FIG. 34, the outer area of the border 327, situated between the cuff layers 325 and 326, of the sleeve 50 is clamped between the supporting plate 62 and the inner clamp 273. The material which is necessary for moving the lateral edge 328 of the border 327 is drawn out of the folding device 140.

Figure 29:
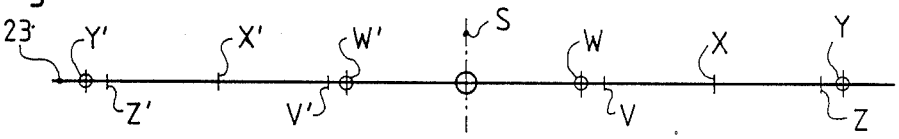
FIG. 29 shows a diagrammatic view of the path of movement of the sewing machine.

After the control system 22 has controlled this clamping operation of the workpieces 52, 50 to be sewn together, a movement of the carriage 6 is effected with the sewing machine 10 stationary, the needle 42 being set in its uppermost position by the sewing machine drive 36 to avoid a collision between the needle 42 and the connecting element 66. This movement of the carriage 6 with the sewing head stationary is also referred to in the following text as the idling movement. In this connection the needle 42 moves along the line 23 (FIG. 29), the idling movement ending at a point V. The sewing machine 10 then commences with the actual sewing operation. From the point V, the seam 54 is produced while producing a seamlock backwards in the direction of an end point W and, from this point, forward in the direction of a point X lying in the central part of the seam 54. Information as to the position of point X on the line 23 is received by the control system 22 by the sensor 260 being activated by means of the permanent magnet 258 associated with the central clamp 256. As soon as point X is reached, the control system 22 causes an interruption in the sewing operation for which purpose the movement of the carriage 6 and therefore the movement of the sewing machine 10 are stopped. After this stoppage the already sewn together areas of the cuff 52 and the lateral edge 328 of the sleeve 50 are released. For this purpose the inner sleeve clamp 97 is opened by the control system 22 by operating the clamp closing drive 91 and the inner clamp 273 is pivoted into its uppermost raised position by removing air from the clamp tilt drive 265 and by the effect of the force of the tension springs 187. Because the inner clamp 273 is pivoted into a particularly high position corresponding to twice the stroke of the tilt drive 265, it is possible that the already sewn together area of cuff 52 and sleeve 50 can be drawn out of its flat position occupied during the sewing operation if the control system 22 has caused the outer sleeve clamp 118 to be moved away in the direction of the axis of symmetry Sr by appropriate triggering of the clamp displacing drive 108. Then the central clamp 256 remains in its position for clamping the cuff 52 and sleeve 50. The movement causes the right lateral edge 329 also to be moved as a result of the clamping action of the outer sleeve clamp 118 and into its ultimate position in relation to the cuff 52. At the same time the material of the sleeve 50 required for this purpose is drawn out of the material fullness stored in the folding device 140 by moving the fold puller 133 in opposition to the force of the compression spring 126. Subsequently, the outer clamp 240 is lowered by operating the clamp tilt drive 184, which is triggered by the control system 22, whereby the right outer section of the cuff 52 is clamped against the supporting plate 62. Again, in this case the outer area of the margin 327 of the sleeve 50 is also clamped. The needles 207 are drawn out of the upper cuff layer 325 by operating the needle drive 327. The lower right cuff holder 170 has already been drawn out of the lower cuff layer 326 and moved downwards. Then the control system 22 causes further production of the seam 54 as far as an end point Y and, from this point, while producing an end interlock, back to a point Z. In this case a thread cutting operation is effected with the aid of the thread cutter 43 integrated in the sewing machine 10.

Figure 25:
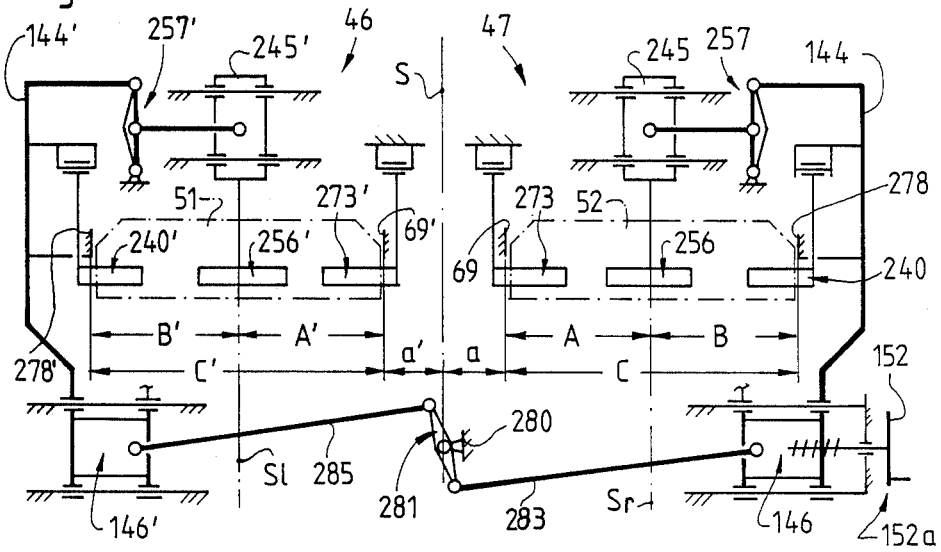
FIG. 25 shows a diagrammatic view of the kinematic linkage between the components of the automatic sewing device.

According to FIG. 31 a sleeve slit 331 is defined on one side of the sleeve placket 56 and on the other side by a seamed edge 330. Because the extended length of this sleeve slit 331 is not sufficient to connect the cuff completely to the sleeve in a flat straight-line sewing operation, it is necessary for the cuff area already sewn to the sleeve 50 to give, which is rendered possible by releasing this sewn section as previously described. Accordingly this partially sewn section as shown in FIG. 25 arches into an drawn-up form which protrudes from the supporting plate 62.

After the sewing operation is completed the carriage 6 with the sewing machine 10 is moved back from point Z, with the needle 42 stationary and set in the upper needle position, until the needle 42 in turn has coincided with the plane of symmetry S. When this position is reached, the drives associated with the right workpiece holder 47 are triggered accordingly so that this workpiece holder 47 reoccupies its initial position. Then the completed sleeve 50 which is sewn together with the cuff 52 by means of the seam 54 can be removed.

During the previously described sewing operation the sewer has time to feed the left workpiece holder 46 in the previously described manner so that an overlapping mode of operation is achieved on the automatic sewing device 1. Because shirts 49 of different sizes also have cuffs 52, 53 designed with different lengths, size adjustment is possible by means of the hand crank 152 whereby the workpiece holders 46, 47 are adjusted simultaneously.

The mode of operation of the sewing machine 290 according to FIG. 26 is such that the control system 22 causes the arm 24 to be pivoted into positions shown by dot-dash lines in FIG. 26 by operating the arm tilt drive 303 and the lower arm 293 to be pivoted by operating the lower arm tilt drive 313 when the carriage 299 executes an idling movement.

Figure 36:
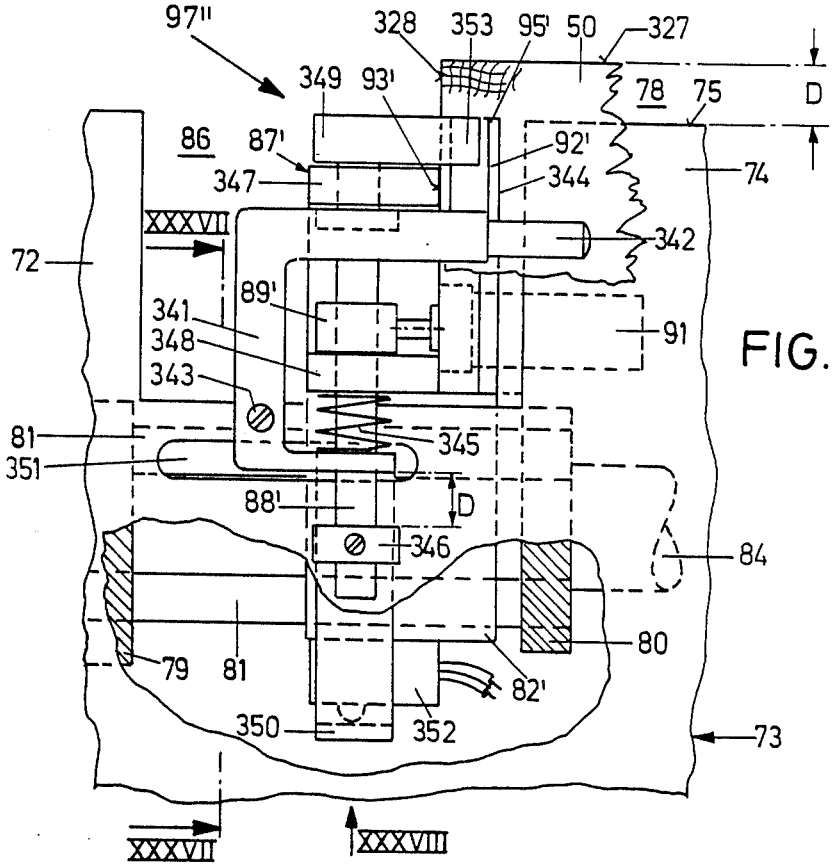
FIG. 36 shows a top plan view of a modified embodiment of a sleeve clamp.
Figure 37:
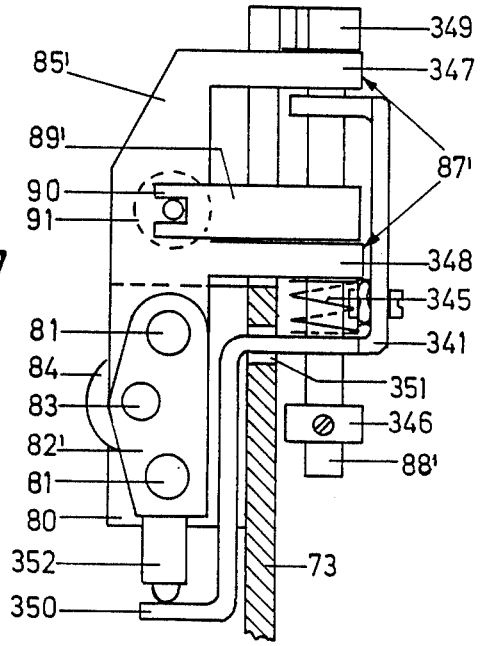
FIG. 37 shows a sectional view through the sleeve clamp along the line XXXVII—XXXVII in FIG. 36.
Figure 38:
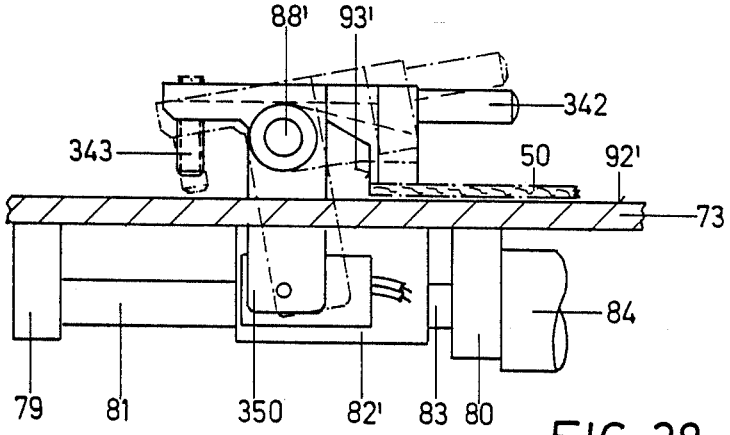
FIG. 38 shows a view of the sleeve clamp in the direction of the arrow XXXVIII in FIG. 36.

In FIGS. 36 to 39 there is illustrated a modified embodiment of an inner sleeve clamp. As far as there will be used identical components of the inner sleeve clamp according to FIG. 16, the same reference numbers are hereinafter used. Components of different construction, but identical in function are hereinafter also designated with the same reference numbers, however provided with an apostrophe. In FIG. 36 there is also provided a U-shaped plate 73, the left side 72 of which is also connected to a connecting piece 66 (not shown in FIG. 36) as illustrated in FIG. 16. The right side 74 of the U-shaped plate 73 is formed with an edge 75, which also in this embodiment limits one side of the slot 78 serving for receiving the tubular stud 42*a*.

Also here below the U-shaped plate 73 there are provided two webs 79, 80, which extend downwardly and in which are mounted two guide rods 81 arranged parallel to the line 23 in FIG. 2. Slidably guided on the guide rods 81 is a sliding bearing 82', which is connected to a piston rod 83 of a clamp displacing drive 84 mounted to the web 80 and being pneumatically operated with double action. The sliding bearing 82' is connected to an arm 85', which projects into the space 86 defined by the two sides 72 and 74. The arm 85' is provided with a bearing 87', in which a shaft 88' is rotatably mounted. Approximately in the middle of the shaft 88' there is attached a drive lever 89', which is connected via a sliding joint connection 90 to a clamp closing drive 91 formed as a single-acting pneumatic piston/cylinder drive. The shaft 88' is non-displaceable with respect to the bearing 87'.

The arm 85' is also provided with a supporting surface 92', which is positioned at the same height or level as the upper side of the supporting plate 62. In the direction of the bearing 87' the supporting surface 92' is defined laterally by a positioning edge 93'.

Figure 39:
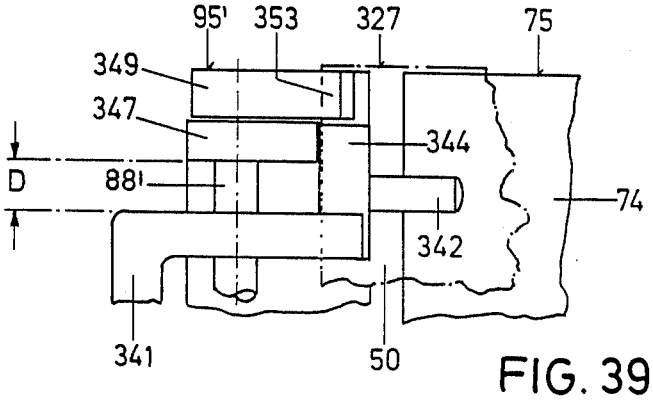
FIG. 39 shows a partial top plan view of the sleeve clamp in inoperative position.

On the shaft 88' there is rotatably and displaceably supported a slide lever 341 formed with an actuating handle 342, which extends substantially horizontally and perpendicularly with respect to the longitudinal direction of the shaft 88'. At the side turned away from the actuating handle 342, the slide lever 341 is provided with an adjustable stop 343 limiting the upward movement of the lever 341 at the side provided with the actuating handle 342 as obvious from FIG. 38. Below with actuating handle 342 there is attached a clamping jaw 344 formed at its lower surface with a toothing. The clamping jaw 344 projects from the slide lever 341 in the direction to the slot 78. Between the sliding lever 341 and a bearing block 348 of the bearing 87' and on the shaft 88' there is arranged a compression spring 345, which displaces the slide lever 341 together with the clamping jaw 344 away from the slot 78 into an inoperative position as illustrated in FIG. 39. here, an adjustable abutment 346 in form of a collar is mounted to the shaft 88', thus determining said inoperative position and thus determining the distance D. The latter represents a dimention, by which the sliding lever 341 may be displaced from its inoperative position into an operative position. In the inoperative position the sliding lever 341 rests on the abutment 346, as the sliding lever 341 abuts against a bearing block 347 of the bearing 87' in ints operative position.

To the free end of the shaft 88' projecting over the bearing block 347 there is mounted a clamping lever 349 projecting over the clamping jaw 344. This clamping lever 349 forms together with the clamping jaw 344 of the slide lever 341 and with the supporting surface 92' an inner sleeve clamp 97'.

The slide lever 341 is provided with a downwardly bent switch lever 350 fuided with clearance through an oblong hole 351 formed in the plate 73. To the sliding bearing 82' there is secured a switch 352, which is actuatable by the displacement of the slide lever 341 against the force of the compression spring 345. The switch 352 controls the clamp closing drive 91 due to a sequence control.

The modified embodiment according to FIGS. 36 to 39 operates as follows: If a sleeve 50 is to be inserted into a cuff (not illustrated in FIGS. 36 to 39) in the afore-described manner, the sleeve 50 will be positioned upon the right side 74 of the plate 73 as its border 327 flushes with the edge 75. In so far there will be accomplished an optical alignment. Moreover, the left lateral edge 328 is positioned against the positioning ede 93'. The right lateral edge 329 will be aligned at a corresponding mirror-symmetrically constructed outer sleeve clamp, which is illustrated in FIGS. 31, 33, 35, and which is identical with the outer sleeve clamp 118 of the afore-described embodiment. During the alignment of the sleeve 50 the slide lever 341 is in its inoperative position at the abutment 346 and tilted upwardly as obvious from FIG. 38. Subsequently, the operator presses the actuating handle 342 downwardly, which causes the clamping jaw 344 to be lowered onto the sleeve 50. The same is done by the operator with the not shown outer sleeve clamp. Then, the operator displaces each slide lever 341 of the two sleeve clamps into the direction towards the slot 78, until each slide lever 341 rests against the bearing block 347. Thus, the sleeve 50 is displaced by the distance D over the edge 75 into a cuff located in the area of displacement of the border 327. At the end of the displacement the switch 352 is triggered by the switch lever 350 for actuating the clamp closing drive 91, so that the clamping lever 349 is tilted as its free end 353 engages the clamping jaw 344 and presses the latter in its advanced position in the direction against the supporting surface 92', so that the sleeve 50 is fixed in this position. Then, the operator can release the corresponding actuating handles 342.

By this measure it is achieved that the border 327 of the sleeve 50 may be inserted over the edge 75 into an operned cuff by the exactly pre-destined, always constant distance D. This increases the quality of the final product and results in time saving.

Figure 40:
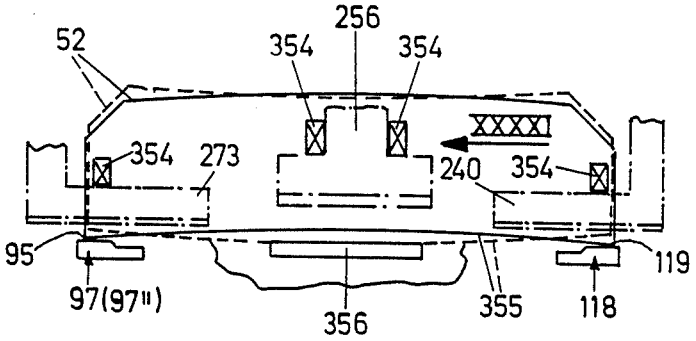
FIG. 40 is a partial top plan view of the automatic sewing device showing the area of the clamps for a cuff inclusive aligning devices for the cuff.

In FIGS. 40 to 44 there are illustrated aligning devices 354 for a cuff 52, which are mounted to the outer clamp 240, the inner clamp 273 and to both sides of the central clamp 256. The function of the aligning devices 354 is to align the cuffs, which are concavely or convexly distorted by the pressing after sewing in such a manner, so that the edge 355 of the cuff 52 is straightlined prior to the clamping by the clamps 240, 256, 273. In FIG. 40 a cuff 52 having a convex edge 355 is illustrated by a dash line, while a cuff 52 having a concave edge 355 is drawn in a full line. The effect of the aligning devices 354 is that regardless of a convex of a concave distorted edge 355 the latter will be aligned at the positioning edges 95 and 119 and a further added stop ledge 356. At the arrangement according to FIGS. 36 to 39 the edge 355 is correspondingly displaced towards a positioning edge 95' at the clamping lever 349. By the aligning devices 354 associated to the central clamp 256 the cuff is as far displaced as the central area of its edge 355 rests against the stop ledge 356, which flushes with the positioning edges 95 resp. 95' and 119. The stop ledge 352 is mounted to the stand 2.

Each aligning device 354, one of which mounted to the central clamp 256 is illustrated in FIGS. 41 to 44, is provided with a C-shaped base plate 357, which is downwardly opened with respect to the supporting plate 62. The base plate 357 is suitably fastened to the central clamp 256 resp. the clamps 240 resp. 273. In the area of the free end of the side 358 of the base plate 357, which projects to the supporting plate 62 and which turns away from the slot 78, there is rotatably articulated an angle lever 359 about a pivot 360. The pivot 360 is located in the area of two arms 361 and 362 extending rectangularly to each other. The arm 361 extending upwardly from the pivot 360, i.e. in parallel with respect to the side 358 of the base plate 357, engages a tension spring 363, the other end of which is secured to the base plate 358. The pre-tensioned spring 363 moves the angle lever 359—in FIGS. 41 and 44 in anti-clockwise direction—in such a manner that the lower horizontally extending arm 362 is held in a position which is in parallel with respect to the supporting plate 62. In this position the arm 361 rests against a stop 364 located at the base plate 357.

In the area of the free end of the arm 362 turned towards the slot 78, there is rotatably supported a tilt plate 365 by means of a journal 366. The tilt plate 365 is formed with a pressing surface 367 which is provided with a roughening or a knurling. The cross section of the pressing surface 367 is profiled as a quarter circle. The center of the pressing surface 367 is formed by the journal 366.

Figure 41:
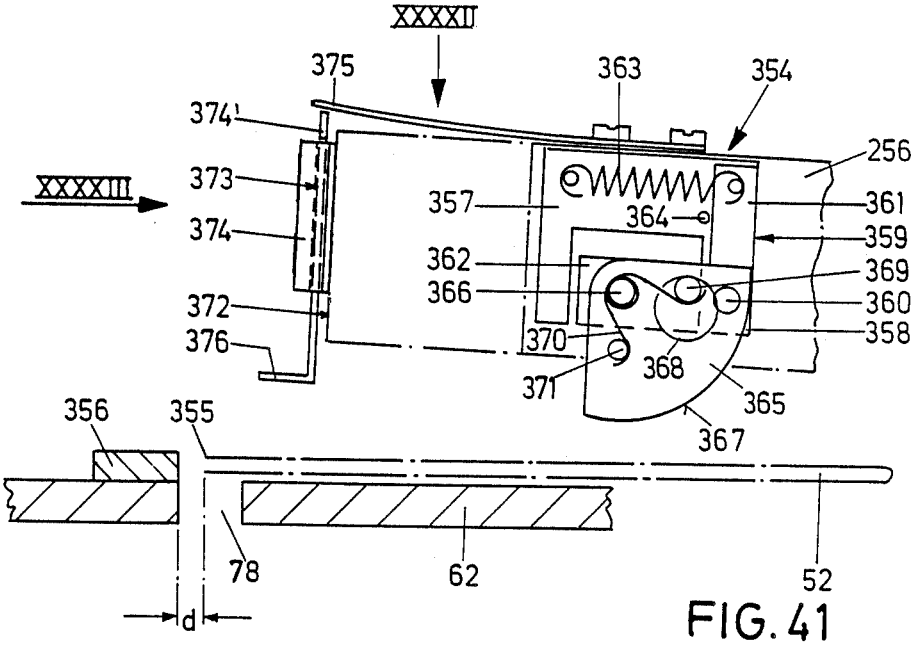
FIG. 41 shows a view of one alignment device in the direction of the arrow XXXXI in FIG. 40.
Figure 42:
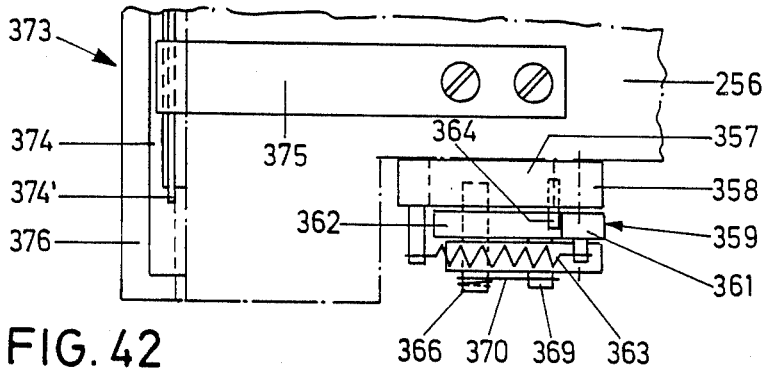
FIG. 42 shows a partial top plan view of one clamp in the area of one aligning device in the direction of the arrow XXXXII in FIG. 41.
Figure 43:
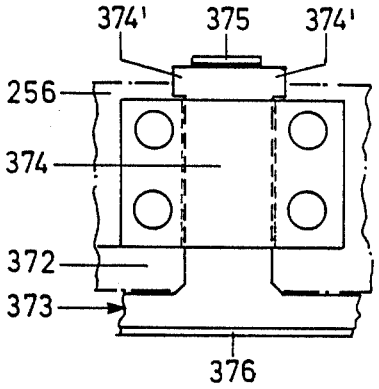
FIG. 43 shows a partial front view of one clamp in the area of one aligning device in the direction of the arrow XXXXIII in FIG. 41.
Figure 44:
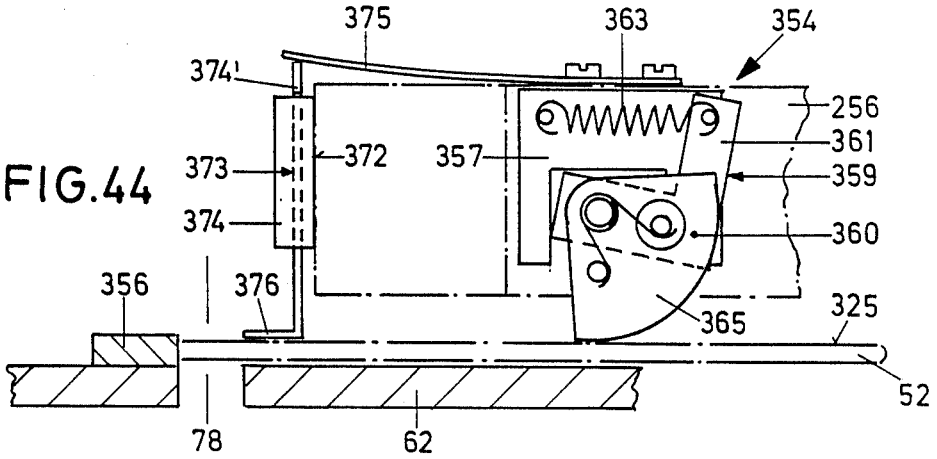
FIG. 44 shows a side view of the aligning device as illustrated in FIG. 41, however lowered onto a cuff.

In the tilt plate 365 there is formed a recess 368 profiled as a circular hole or a curved oblong hole, through which passes a limiting pin 369 fastened to the lower arm 362 of the angle lever 359. Furthermore, on the tilt plate 365 there is attached an operating lever spring 370, which is about symmetrically arranged with respect to and supported on the journal 366. One end of the spring 370 supports at the limiting pin 369, while the other end supports at a holding pin 371 located on the tilt plate 365. The spring 370 is pre-tensioned in such a manner that, when pulled apart, i.e. the spring displaces the tilt plate 365 relative to the angle lever 359, the limiting pin 369 abuts against the upper border of the recess 368. This means in other words that the spring 370 displaces the tilt plate 365—in FIGS. 41 and 44 illustrated in clockwise direction—opposite to the tilt direction of the angle lever 359 imparted by the tension spring 363. Consequently, the spring 370 moves the pressing surface 367 into the direction towards the slot 78 resp. the stop ledge 356.

At the front surface 372 of the clamp 256 turned to the slot 78 and thus to the stop 356 there is arranged a press pad 373 which is vertically displaceable in a guide 374 until two projections 374' abut against the guide 374. The upper end of the press pad 373 supports against a leaf spring 375, which is secured to the clamp 256 and which downwardly moves the press pad 373 in its guide 374. At the lower surface of the press pad 373 there is formed a hold down surface 376. Press pads of such type are also installed at the clamps 240 and 273.

Operation of the aligning device 354 is as follows:

On the supporting plate 62 there is positioned a cuff 52, the edge 355 of which is convexly or concavely curved. Upon lowering of the central clamp 256 and similar of the clamps 240 resp. 273 each individual tilt plate 365 contacts with its pressing surface 367 the upper cuff layer 325, while both the tilt plate 365 and the angle lever 359 take in their inoperative positions as shown in FIG. 41. Upon the further lowering of the clamp 256 the angle lever 359 together with the tilt plate 365 is tilted about the pivot 360 against the force of the tension spring 363, i.e. in clockwise direction. If, prior to the lowering of the tilt plate 365, the edge 355 of the cuff 52 had a distance d from the stop ledge 356 due to a nonlinearity of this edge, then the cuff 52 is displaced by a corresponding tilting of the angle lever 359 together with the tilt plate 365, until the edge 355 rests against the stop ledge 356 and the positioning edges 95 and 119. In this position the holding down surface 376 of the press pad 373 gets into contact with the cuff 52 and presses the latter against the supporting plate 62 with the force of the springs 375.

Now, due to the stiffness of the cuff 52, a force acts upon the tilt plate 365, which engages the pressing surface 367 and which is directed from the stop ledge 356 in parallel with the supporting plate 62—i.e. to the right side according to FIGS. 41 and 44. This force causes the tilt plate 365 to be tilted about the journal 366 against the force of the spring 370 into an opposite direction with respect to its previous tilt direction. Although the clamp 256 will be further lowered and although also the angle lever 359 is further tilted against the force of the tension spring 363, the tilt plate 365 does not move the cuff 52 further in the direction towards the stop ledge 356, as the motion imparted to the tilt plate 365 by the tilted angle lever 359 in the direction to the stop ledge 356 is compensated by the oppositely directed tilt motion about the journal 366 against the force of the spring 370. Consequently, each aligning device 354 moves the cuff 52 in the direction towards the stop ledge 356 resp. 95, 95' resp. 119 only until the edge 355 rests against the latter, i.e. the edge 355 of the cuff 52 is linearly aligned. At the aligning procedure of the edge 355 finally also the hold down surfaces 376 get into contact with the cuff 52, so that an upwardly vaulting of the cuff 52 in a direction away from the supporting plate 62 will be prevented. Subsequently, movement of the pressing surface 367 and thus the cuff 52 caused by the angle lever 359 is compensated by an oppositely directed tilt motion of the tilt plate 365.

The next following operations, e.g. the opening of the cuff 52 etc., will follow as already described above.

What is claimed is:

1. Automatic sewing device for sewing together a margin of a tubular workpiece, which has a placket dividing the margin, and a pocket-shaped workpiece including two partially connected plies, and having an opening between said two plies, the placket being bound by lateral edges delimiting ends of the margin, which margin has a material fullness, the device comprising:

a sewing machine;

at least one workpiece holder having at least one support for supporting the workpieces, stops for positioning the workpieces, devices for opening the pocket-shaped workpiece, an inner clamp and an outer clamp for clamping the pocket-shaped workpiece, the inner clamp and the outer clamp being operable independently from one another;

clamps for retaining the tubular workpiece on said lateral edges in the area of said margin, which clamps are movable independently from one another out of an inner position for receiving the tubular workpiece into an outer position; and at least one folding device for gathering up said material fullness.

2. Automatic sewing device according to claim 1, wherein there is provided between the inner clamp and the outer clamp a central clamp for the pocket-shaped workpiece, which central clamp is operable independently from these inner and outer clamps.

3. Automatic sewing device according to claim 1, wherein there are provided upper and lower holders which grip the pocket-shaped workpiece on outer surfaces of its two plies and which holders are drivable perpendicularly to said support.

4. Automatic sewing device according to claim 3, wherein each holder has needles which are insertable approximately parallel to the support into one of the plies and which are drivable at least approximately parallel to said support.

5. Automatic sewing device according to claim 3, wherein the uppper holders are integrated in the inner clamp and the outer clamp, respectively.

6. Automatic sewing device according to claim 1, wherein one clamp for clamping the pocket-shaped workpiece and an adjacent clamp for one of said lateral edges are fixed relative to the workpiece holder, and the other clamp for clamping the pocket-shaped workpiece and an adjacent clamp for the other one of said lateral edges are jointly adjustable relative to the workpiece holder by means of an adjustment device.

7. Automatic sewing device according to claim 6, wherein there is provided between the inner clamp and the outer clamp a central clamp for the pocket-shaped workpiece which central clamp is operable independently from these inner and outer clamps and wherein the central clamp is connected to said other clamp via a dividing gear and is adjustable relative to the workpiece holder.

8. Automatic sewing device according to claim 6, wherein there are provided two workpiece holders which are mounted symmetrically with respect to one another and which are linked kinematically for a joint adjustment of the clamps.

9. Automatic sewing device according to claim 8, wherein the workpiece holders are arranged together on a stand, and wherein the sewing machine is arranged on the stand so as to be movable in a straight line.

10. Automatic sewing device according to claim 1, wherein a slot is provided in the workpiece holder for the needle of the sewing machine to pass through, the slot being closed on a side adjacent to the sewing machine when the latter is in an inoperative position, and wherein the sewing machine has a lower arm and an upper arm, at least one of which being pivotable.

11. Automatic sewing device according to claim 1, wherein each clamp for holding the lateral edges of the tubular workpiece is provided with a clamping jaw for one lateral edge of the tubular workpiece, said clamping jaw being actuatable by means of a slide lever and displaceable in direction to the pocket-shaped workpiece by a pre-set distance for inserting the margin of the tubular workpiece into the opened pocket-shaped workpiece.

12. Automatic sewing device according to claim 11, wherein the slide lever with the clamping jaw is displaceable in direction to the pocket-shaped workpiece against the force of a compression spring.

13. Automatic sewing device according to claim 11, wherein the slide lever is provided with a switch lever, which abuts against a switch operating a clamp closing drive, when the slide lever is in a position in which the margin of the tubular workpiece is inserted into the opened pocket-shaped workpiece.

14. Automatic sewing device according to claim 2, wherein to the outer clamp, to the inner clamp and to the center clamp there are arranged aligning devices, by means of which an edge of the pocket-shaped workpiece to be stitched together with the tubular workpiece is displaceable against at least one stop ledge.

15. Automatic sewing device according to claim 14, wherein each aligning device is provided with a tilt plate comprising a pressing surface placeable onto the pocket-shaped workpiece, the tilt plate being tiltaby pivoted to a lever and tiltable against the force of a spring, which lever is tiltably pivoted to one of said inner clamp, outer clamp and center clamp, respectively, and is tiltable against the force of a spring.

* * * * *